US005697152A

United States Patent [19]

Yamazaki et al.

[11] Patent Number: 5,697,152

[45] Date of Patent: Dec. 16, 1997

[54] METHOD OF MANUFACTURING AN IMPELLER

[75] Inventors: Susumu Yamazaki, Tsuchiura; Eiichi Ito, Narashino; Hiroshi Asabuki; Masayuki Fujio, both of Sakura; Hajime Fujita, Tsuchiura; Kazuo Kobayashi, Chiba; Kengo Hasegawa, Sakura; Yukio Chihara, Chiba; Hiromoto Ashihara, Funabashi; Takashi Watanabe, Narita; Kanzi Mizutani, Sakura; Yuichi Nakatsuhama, Narita; Yukio Makuta, Narashino; Kazuo Yanagiya, Funabashi; Tomoya Tamura, Sakura, all of Japan

[73] Assignee: Hitachi, Ltd., Tokyo, Japan

[21] Appl. No.: 351,183

[22] Filed: Nov. 30, 1994

Related U.S. Application Data

[60] Division of Ser. No. 24,870, Feb. 1, 1993, Pat. No. 5,395, 210, which is a continuation-in-part of Ser. No. 479,521, Feb. 13, 1990, abandoned.

[30] Foreign Application Priority Data

| | | | |
|---|---|---|---|
| Feb. 13, 1989 | [JP] | Japan | 1-031033 |
| Mar. 3, 1989 | [JP] | Japan | 1-051390 |

[51] Int. Cl.[6] ..... B23P 15/00

[52] U.S. Cl. ..... 29/889.21; 29/889.22

[58] Field of Search ..... 29/889.21, 889.22, 29/445, 458, 460, 469.5, 505, 513, 521, 525.1

[56] References Cited

U.S. PATENT DOCUMENTS

| | | | |
|---|---|---|---|
| 1,655,749 | 1/1928 | Burks . | |
| 1,871,209 | 8/1932 | Burks . | |
| 1,973,669 | 9/1934 | Spoor . | |
| 3,095,820 | 7/1963 | Sanborn et al. . | |
| 3,147,541 | 9/1964 | Hathaway . | |
| 3,545,890 | 12/1970 | Hubbard et al. . | |
| 3,768,920 | 10/1973 | Gerwin . | |
| 3,951,567 | 4/1976 | Rohs . | |
| 4,575,911 | 3/1986 | Laszlo | 29/889.21 |
| 4,987,944 | 1/1991 | Parks | 29/889.21 |
| 5,281,083 | 1/1994 | Ito et al. . | |

FOREIGN PATENT DOCUMENTS

| | | |
|---|---|---|
| 2145915 | 1/1973 | France . |
| 1703329 | 3/1972 | Germany . |
| 2400496 | 6/1974 | Germany . |
| 3128625 | 3/1982 | Germany . |

(List continued on next page.)

OTHER PUBLICATIONS

Transaction of Japan Machinery Society, vol. 45, Aug., 1979, pp. 1109–1116 Hitachi Vortex Blowers, G Series (no date).

Partial Translation of "Transaction of Japan" Machinery Society, vol. 45, (Aug. 1979, pp. 1108–1116) (p. 1112, left col., line 4–13).

*Primary Examiner*—Irene Cuda

*Attorney, Agent, or Firm*—Antonelli, Terry, Stout & Kraus, LLP

[57] ABSTRACT

A vortex flow blower used as an air source to be incorporated into general industrial machines. The vortex flow blower is characterized in that the shape of the blade in its impeller is three dimensionally formed such that at least the inner portion of the blade can be adapted to the three dimensional internal flow. According to the present invention, the aerodynamic performance can be significantly improved and the size of a vortex flow blower can be reduced. Furthermore, an impeller having three dimensionally shaped blades is manufactured by independently manufacturing the shroud and the blades and coupling them, so that the impeller of a complicated shape can be readily manufactured. Furthermore, since the blade can be made of a thin and light material, the secondary moment of inertia of the impeller can be reduced.

2 Claims, 31 Drawing Sheets

FOREIGN PATENT DOCUMENTS

| | | |
|---|---|---|
| 3520218 | 12/1985 | Germany . |
| 3605852 | 8/1987 | Germany . |
| 8808920 | 10/1988 | Germany . |
| 0274469 | 12/1989 | Germany . |
| 2361851 | 2/1993 | Germany . |
| 0005914 | 1/1975 | Japan . |
| 0057011 | 5/1976 | Japan . |
| 0048158 | 11/1980 | Japan . |
| 0085091 | of 1981 | Japan . |
| 0155696 | 7/1986 | Japan . |
| 309096 | 8/1917 | Netherlands . |
| 892498 | 8/1953 | Netherlands . |
| 0447900 | 5/1936 | United Kingdom . |
| 718751 | 11/1954 | United Kingdom . |
| 733578 | 7/1955 | United Kingdom . |
| 983687 | 2/1965 | United Kingdom . |
| 1155049 | 6/1969 | United Kingdom . |

| | |
|---|---|
| RADIUS AT MIDPOINT | $Rc=(R1+R2)/2$ |
| RADIUS OF OUTER CROSS SECTION | $Ro=(R2+Rc)/2$ |
| RADIUS OF INNER CROSS SECTION | $Ri=(Rc+R1)/2$ |

SECTION A-A

SECTION B-B

SECTION C-C

FIG. 15

PRESSURE COEFFICIENT RATIO $\psi/\psi_0$ DISTRIBUTION ($\beta_1=90°$, $\gamma_i=90°$, $\beta_2=90°$)

| $\beta_1$ \ $\gamma_i$ | 10° | 20° | 45° | 70° | 80° | 90° |
|---|---|---|---|---|---|---|
| 100° | | | | | | 0.8 |
| 90° | 0.6 | 1.4 | 1.7 | 1.3 | 1.1 | 1.0 |
| 80° | 1.0 | 1.8 | 2.0 | 1.8 | 1.6 | 1.1 |
| 60° | | 2.0 | 2.5 | 22 | 1.9 | 1.1 |
| 45° | | 1.8 | 2.0 | 2.0 | 1.6 | 1.3 |
| 20° | | | 1.4 | | | 1.4 |

FIG. 16

PRESSURE COEFFICIENT RATIO $\psi/\psi_0$ DISTRIBUTION ($\beta_1=90°$, $\gamma_i=90°$, $\beta_2=70°$)

| $\beta_1$ \ $\gamma_i$ | 10° | 20° | 45° | 70° | 80° | 90° |
|---|---|---|---|---|---|---|
| 100° | | | | | | 0.7 |
| 90° | 0.5 | 0.8 | 1.1 | 1.0 | 0.8 | 0.7 |
| 80° | 0.6 | 1.3 | 1.3 | 1.4 | 1.2 | 0.8 |
| 60° | | 1.4 | 1.3 | 1.3 | 1.3 | 1.0 |
| 45° | | 1.3 | 1.3 | 1.3 | 1.0 | 1.0 |
| 20° | | 1.0 | | | | |

RADIUS AT MIDPOINT $Rc=(R1+R2)/2$

RADIUS OF OUTER CROSS SECTION $Ro=(R2+Rc)/2$

RADIUS OF INNER CROSS SECTION $Ri=(Rc+R1)/2$ $\gamma c < \gamma o$ $\gamma c < \gamma i$

SECTION IV1-IV1

SECTION IV2-IV2

SECTION IV3-IV3

SECTION IV4-IV4

SECTION IV5-IV5

SECTION
IH4 – IH4

SECTION
IH3 – IH3

SECTION
IH2 – IH2

IH1 – IH1

SECTION BV4-BV4

SECTION BV3-BV3

SECTION BV2-BV2

SECTION BV1-BV1

SECTION BV5-BV5

SECTION BV6-BV6

SECTION BV7-BV7

SECTION BV8-BV8

BH1 – BH1

SECTION BH2 - BH2

SECTION BH3 - BH3

SECTION BH4 - BH4

PRESSURE COEFFICIENT RATIO $\psi/\psi_0$ DISTRIBUTION ($\beta_2=90°$, $\gamma_0=90°$)

| $\beta_2$ \ $\gamma_0$ | 10° | 20° | 45° | 70° | 80° | 90° |
|---|---|---|---|---|---|---|
| 80° | | | | | | 0.8 |
| 90° | 0.6 | 1.4 | 1.3 | 1.3 | 1.1 | 1.0 |
| 100° | 1.0 | 1.8 | 1.9 | 1.9 | 1.6 | 0.8 |
| 115° | | 2.0 | 2.4 | 2.3 | 1.8 | 0.7 |
| 135° | | 1.9 | 2.1 | 2.0 | 1.6 | 0.6 |

RADIUS AT MIDPOINT $Rc = (Ri + R2)/2$

RADIUS OF OUTER CROSS SECTION $Ro = (R2 + Rc)/2$

RADIUS OF INNER CROSS SECTION $Ri = (Rc + Ri)/2$

SECTION BV4-BV4

SECTION BV3-BV3

SECTION BV2-BV2

SECTION BV1-BV1

SECTION BV5-BV5

SECTION BV6-BV6

SECTION BV7-BV7

SECTION BV8-BV8

SECTION IV1 - IV1

SECTION IV2 - IV2

SECTION IV3 - IV3

SECTION IV4 - IV4

SECTION IV5 - IV5

METHOD OF MANUFACTURING AN IMPELLER

RELATED APPLICATIONS

This application is a divisional of U.S. application Ser. No. 08/024,870 filed Mar. 1, 1993, and now U.S. Pat. No. 5,395,210 issued Mar. 7, 1995 which in turn is a continuation-in-part of U.S. application Ser. No. 07/479, 521, filed Feb. 13, 1990, and now abandoned.

FIELD OF THE INVENTION

The present invention relates to a vortex flow blower used as an air source to be incorporated into a general industrial machine such as an apparatus for transporting pulverized materials, an absorber for paper or an aeration apparatus, and, more particularly, to the shape of impeller blades capable of significantly improving the aerodynamic performance of a vortex flow blower, the shape of a casing suitable for the shape of the blades and a manufacturing method therefor.

BACKGROUND OF THE INVENTION

Previously the vortex flow blower has usually been provided with blades formed radially in the impeller. Since the vortex flow blower exhibits an advantage in that high wind pressure can be obtained with reduced size, a variety of disclosures and studies have been made for the purpose of improving the above-identified advantage.

For example, a study is disclosed in Transaction of Japan Machinery Society, Vol. 45 (published in August 1979), P. 1108–1116. According to the study, the characteristic (i.e., the characteristic about the relationship between discharge flow rate and discharge pressure) of the vortex flow blower is changed by changing the ratio $R_1/R_2$, where $R_1$ represents the radius of a circle connecting the inner end of a blade and the axial center and $R_2$ represents a radius connecting the outer end of the blade and the axial center. According to this it is disclosed that both the flow rather coefficient and the pressure coefficient are higher when the value of $R_1/R_2$ is 0.68 than when it is 0.82, and they become higher when the value is 0.75. In the vortex flow blowers which have been put into practical use, the smallest value of $R_1/R_2$ is about 0.68.

Although $R_2$ must be a small value for the purpose of reducing the size of the vortex flow blower, the following problems arise; namely, the value of $R_1/R_2$ must be decreased when the desired flow rate is satisfied with a reduced size of the vortex flow blower since the flow rate significantly depends upon the value of $R_2^2$ $(1-R_1/R_2)$. However, if the value of $R_1/R_2$ is reduced to 0.75 or less, the pressure coefficient becomes smaller as described above. Furthermore, since the outer radius $R_2$ has been reduced, peripheral speed $u_2$ at the outer radius $R_2$ is also lowered, thereby causing the discharge pressure to be excessively lowered since the pressure characteristic is determined by the product of the pressure coefficient and the square of $u_2$. Therefore, $R_2$ must be a small value, and $R_1/R_2$ must be a small value and the pressure coefficient must be significantly increased in order to reduce the size of the vortex flow blower.

When improved characteristics are desired without any change in the size of the vortex flow blower, the following problem arises; namely, if the value of $R_1/R_2$ is increased to about 0.75 for the purpose of improving the pressure performance in the case where the value of $R_1/R_2$ is constant, the flow rate is inevitably reduced and, on the contrary, if the value of $R_1/R_2$ is reduced for the purpose of increasing the flow rate, the pressure coefficient is lowered. Therefore, when an improved characteristic is desired without changing the size of the vortex flow blower, $R_1/R_2$ must be reduced and the pressure coefficient must be increased.

Vortex flow blowers designed to improve their aerodynamic performance are disclosed, for example, in Japanese Patent Unexamined Publication No. 50-5914 and Japanese Patent Unexamined Publication No. 61-155696, each of which is provided with an impeller formed in such a manner that only the axial inlet angle and the exit angle of its blade are inclined at a certain angle which is respectively smaller or larger than 90 degrees. Furthermore, vortex flow blowers, although their objects are unclear, are disclosed in Japanese Utility Model Examined Publication No. 55-48158 and Japanese Utility Model Unexamined Publication No. 56-85091, each of which is provided with an impeller formed in such a manner that both or one of the inlet angle and the exit angle in the circumferential direction of its blade are or is inclined at a certain angle which is different from 90 degrees.

Further, a method of manufacturing an impeller is disclosed in Japanese Patent Unexamined Publication No. 51-57011, and according to this method the impeller is composed of two pieces divided in its axial direction in order to make a core unnecessary when forming the impeller from a casting, and the thus divided two pieces are coupled to each other afterwards.

Since the vortex flow blower exhibits an advantage in that it can serve as a clean air source with a reduced size, it has recently been widely used. Therefore, there arises a desire for the vortex flow blower which is capable of generating higher wind pressure and whose size is reduced with the discharge pressure maintained as it is. However, in the conventional technologies including the above-described technologies, only one of the exit angle in the circumferential direction, the inlet angle and the axial angle of the blade is taken into consideration and the shape of the blade is not formed so as to be adapted to the three dimensional internal flow which takes place inherently in the vortex flow blower, so that turbulence of internal flow such as swirls and stagnation cannot be prevented. Therefore, the following problems arise that it is difficult to further reduce the size of the vortex flow blower and a predetermined pressure maintained, and it is difficult to obtain higher discharge pressure with the flow rate maintained without enlarging the size of the vortex flow blower.

Furthermore, since the conventional vortex flow blower have been insufficient in terms of noise reduction, they cannot be used as medical equipment or the like which are used in quiet environments.

In addition, according to the method of manufacturing an impeller disclosed in Japanese Patent Unexamined Publication No. 51-57011, it is difficult to manufacture an impeller blade having a three dimensional shape.

Furthermore, when the impeller is manufactured by a low pressure casting process, since there are problems of run or fluidity it is difficult to reduce thickness to the blade. Therefore, it is difficult to reduce the secondary moment of inertia of the impeller, thereby causing starting torque when starting the impeller and, as a result, the size of the motor cannot be reduced.

Furthermore, the metal mold used when the impeller is manufactured by an integral molding process such as die-casting or chill-casting process is expensive, so that it is difficult to inexpensively manufacture an impeller having different aerodynamic performance.

SUMMARY OF THE INVENTION

The present invention has been accomplished in view of the foregoing, and a first object of the present invention is to provide a vortex flow blower exhibiting improved aerodynamic performance in comparison with the conventional vortex flow blower.

A second object of the present invention is to provide a vortex flow blower having reduced noise.

A third object of the present invention is to provide a vortex flow blower whose aerodynamic performance is significantly improved and whose discharge pressure can be controlled to a set value.

A fourth object of the present invention is to provide a vortex blower having a reduced size.

A fifth object of the present invention is to provide a method of efficiently and easily manufacturing an impeller even if it has a complicated shape.

A sixth object of the present invention is to provide a method of manufacturing an impeller having reduced secondary moment of inertia.

A seventh object of the present invention is to provide a method of inexpensively manufacturing impellers having different aerodynamic characteristics by manufacturing only the blades of different shapes.

In order to achieve the above-described objects, the first aspect of the present invention lies in that the shape of the blade is formed in a proper three dimensional shape such that at least the inner portion of the blade is adapted to the three dimensional internal flow.

That is, when it is assumed that the radius of a circle connecting the inner end of the blade and the axial center is $R_1$, the inlet angle of the front edge of the blade in the inner end is $\gamma_1$, the inlet angle at the front edge of the blade in an intermediate portion between the inner end and a central portion is $\gamma_i$, the radius at a center between the inner end and the outer end is $R_c$, the shape of the blade is formed by a smoothly curved surface so as to make at least $\gamma_1$, $\gamma_i$ and $\gamma_c$ smaller than 90 degrees and to meet the relationship of $\gamma_1>\gamma_c$ or $\gamma_1>\gamma_c$. Further, it may be formed so as to make $\gamma_1$ less than 90 degrees and to meet the relationship of $\gamma_1>\gamma_c$.

Furthermore, the position of the blade at its front edge on a circle whose radium is $R_c$ is arranged to delay with respect to the direction of rotation of the impeller than that at its inner end.

The second aspect lies in that the shope of the blade of the impeller is three dimensionally formed such that the inner and the outer portions of the blade are adapted to the three dimensional internal flow, thereby projecting the front edge of the outer portion of the blade with respect to the direction of rotation of the impeller.

The third aspect lies in that the front edge of the outer portion of the blade is retracted with respect to the direction of rotation of the impeller and $\gamma_0$ is greater than 90 degrees.

The fourth aspect lies in that as mentioned before the shape of the blade of the impeller is three dimensionally formed and $R_1/R_2$ is set to 0.75 or less and, preferably, in a range of between 0.75 or less and 0.3 or more.

The fifth aspect lies in that the shape of the casing of the vortex flow blower is formed in such a manner that the shape of a partition wall thereof is formed so as to cause fluid to be introduced and discharged along the shape of the blade.

The sixth aspect lies in that the blade is formed in such a manner that a lower most or bottom portion of the blade at a shroud side is retracted with respect to the rotational direction compared with a front edge of the blade at its inner end and a center portion of the blade becomes situated substantially right above a portion of the blade adjacent the shroud wall surface.

Further, the seventh aspect lies in that the blade is formed in three dimensional shape so as to form a three dimensional passage defined by the neighboring blades and the shroud wall surface to provide therein an inflow portion, a flow direction converting portion and an outflow portion. And, it is adapted such that, in the inflow portion, an inclined flow is caused, in a direction opposite to the rotational direction of the impeller and towards the shroud side; that, in the flow direction converting portion, the inflowing inclined flow is caused to flow along an outer circumferential side of the shroud wall surface; and that, in the outflow portion, the flow is caused to flow in the same direction as the rotational direction of the impeller and in a direction going away from the shroud wall surface.

The eighth aspect lies in that a thickness of the blade is increased in a backface side of the blade adjacent the shroud wall surface.

In order to achieve the fifth object of the present invention, the method of manufacturing an impeller according to the present invention comprises the steps of independently manufacturing the shroud and the blades so as to form the impeller. Further, as occasion demands, a filler may be filled into the corners between the base portion of the shroud and the blades.

Furthermore, in the method of manufacturing an impeller according to the present invention, grooves into which the blades are to be inserted are formed in the annular groove formed in the shroud by the number corresponding to the number of the blades so that the impeller is formed by inserting the blades into these grooves.

Furthermore, in the method of manufacturing an impeller according to the present invention, cores each of which has such a structure that, when the impeller has been formed by casting, neighboring blades partitioning the annular groove of the shroud, are positioned on the circumference at a predetermined interval, fluid (e.g. molten alloy) is poured between the neighboring cares and between the core and the outer mold, and the fluid is solidified so that the impeller is manufactured.

Furthermore, in the method of manufacturing an impeller according to the present invention, impeller component units each of which has neighboring blades and a part of the annular groove of the shroud formed therebetween are manufactured, and a plurality of these units are assembled to each other on the circumference so that the impeller is manufactured.

In order to achieve the above-describe sixth object, in the method of manufacturing an impeller according to the present invention, the blades are made of thin and light material.

In order to achieve the above-described seventh object, the method of manufacturing an impeller according to the present invention is characterized in that the impeller is manufactured by manufacturing only the blades so as to have different shapes and coupling the manufactured blades and the shroud.

BRIEF DESCRIPTION OF THE DRAWINGS

FIGS. 15 and 16 are tables showing text data of the embodiment according to the present invention in comparison with those of the conventional technology;

FIG. 21 is a perspective view of an impeller;

FIG. 22 is a perspective view which visually expresses the angle at each of the portions of the impeller shown in FIG. 21 by means of composing with multiple plans;

FIG. 23 is an enlarged plan view which illustrates a part of the impeller shown in FIG. 21;

FIGS. 24 to 26 are cross sectional views respectively taken along lines A—A, B—B and C—C of FIG. 23;

FIG. 27 is a graph which illustrates the transitions of the axial inlet angle and exit angle at each of the portions in the impeller shown in FIG. 21;

FIG. 28 is a front view of an impeller according to one embodiment of the present invention;

FIG. 29(*a*) is a drawing including a partial front view of the impeller shown in FIG. 28, FIG. 29(*b*) is a vertical sectional view and FIGS. 29(*c*), 29(*d*), 29(*e*), 29 (*f*) and 29(*g*) are developed views of a part of the impeller sectioned at respective radially various positions $IV_1$—$IV_1$, $IV_2$—$IV_2$, $IV_3$—$IV_3$, $IV_4$—$IV_4$ and $IV_5$—$IV_5$ in FIG. 29(*a*);

FIG. 30(*a*) is a vertical sectional view of a part of the impeller in FIG. 28 and FIGS. 30(*b*), 30(*c*), 30(*d*) and 30(*e*) are drawings including partial cross-sectional views of a part of the impeller taken along the lines $1H_4$—$1H_4$, $1H_3$—$1H_3$, $1H_2$—$1H_2$ and $1H_1$—$1H_1$, respectively in FIG. 30(*a*);

FIG. 31(*a*) is a drawing of a front view, FIG. 31(*b*) a plan view and FIG. 31(*c*) a side view, of a blade according to one embodiment of the present invention;

FIG. 32 is a view like that in FIG. 31(*a*) but with section lines at various positions as indicated therein;

FIGS. 33(*a*), 33(*b*), 33(*c*), 33(*d*), 33(*e*), 33(*f*), 33(*g*) and 33(*h*) are sectional views of the blade sectioned at respective positions $BV_4$—$BV_4$, $BV_3$—$BV_3$, $BV_2$—$BV_2$, $BV_1$—$BV_1$, $BV_5$—$BV_5$, $BV_6$—$BV_6$, $BV_7$—$BV_7$ and $BV_8$—$BV_8$ shown in FIG. 32;

FIG. 49 is a perspective view which illustrates the vortex flow blower in which a double-blade impeller is mounted;

FIG. 50 is a perspective view which illustrates the double-blade impeller;

FIGS. 51 to 53 are cross sectional views respectively taken along lines A—A, B—B and C—C of FIG. 50;

FIG. 54 is a front elevational view which illustrates the shape of a blade;

FIG. 55 is a vertical sectional view which illustrates the shape of a shroud;

FIGS. 56 to 59 are vertical cross sectional views each of which illustrates a plastic working process when the blade and the shroud are coupled to one another;

FIG. 60 is a vertical sectional view which illustrates an embodiment in which a filler is filled in a corner portion between the blade and the shroud;

FIG. 61 is a perspective view which illustrates the blade to which a skin material is brazed;

FIG. 62 illustrates a method of manufacturing an impeller by using a ultrasonic oscillator;

FIG. 63 is a perspective view which illustrates the shape of the blade;

FIGS. 64 to 67 are vertical sectional views which illustrate an another method of manufacturing an impeller according to the present invention arranged in such a manner that the blade and the shroud are coupled to one another by screw;

DESCRIPTION OF THE PREFERRED EMBODIMENTS

Figure 1:
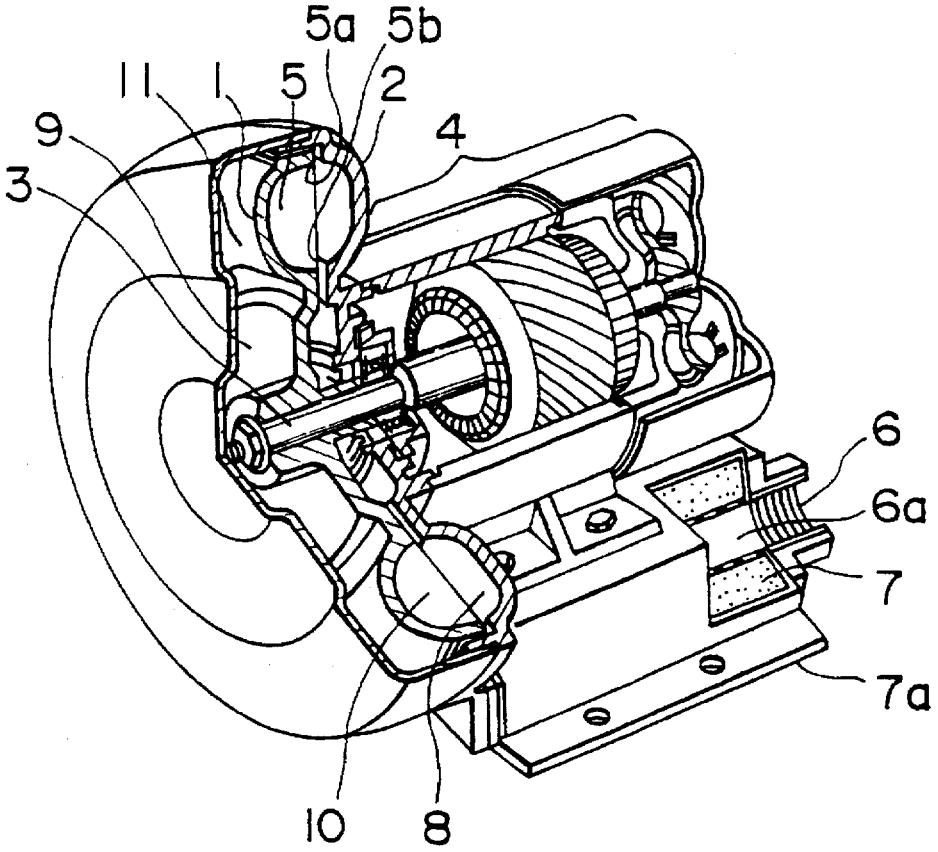
FIG. 1 is a perspective view which illustrated an embodiment of a vortex flow blower according to the present invention.

Referring now to the drawings wherein like reference numerals are used throughout the various views to designate like parts and more particularly to FIG. 1, according to this figure, a vortex blower in accordance with the present invention includes an impeller 1 and a casing 2 forming an annular passage 8, and a motor 4 for rotating the impeller 1. The impeller 1 and the casing 2 are formed to face each other and the impeller 1 is fastened in such a manner that the impeller i can rotate with respect to the casing 2. The motor 4 is placed on the base member 7*a* in such a manner that the motor 4 is secured to both the base member 7*a* and the casing 2. An end of the annular passage 8 is communicated to an inlet passage 6*a* and the other end of the same is communicated to an outlet passage (not shown in FIG. 1). The inlet passage 6*a* and the outlet passage are formed in a muffler 7 which also serves as a base member. The annular passage 8 is formed around the rotational center of the impeller 1, that is, around the rotational shaft 3 of the motor 4. The cross sectional shape of the annular passage 8 forms a semicircular arc when it is cut by a plane passing through the axial center of the rotational shaft 3. A partition wall is formed between an inlet port and an outlet port each of which is communicated with the annular passage 8, the partition wall being formed with a small gap maintained for the purpose of permitting a plurality of blades 5 formed in the impeller 1 to pass through. Thus, the communication between the inlet port and the outlet port is prevented by the partition wall. The impeller 1 is constituted by a wheel 9 and a shroud 11 which are secured to the rotational shaft 3 of the motor 4 and are capable of rotating while integrated to each other. The shroud 11 has a passage 10 formed therein, with the passage 10 having a plurality of blades 5 formed in a direction traversing the passage 10.

In the vortex flow blower of this embodiment, the shape of the blade 5 is, as shown in FIGS. 2 to 6, formed in such a manner that at least the inner portion thereof has a three dimensional shape.

Figure 7:
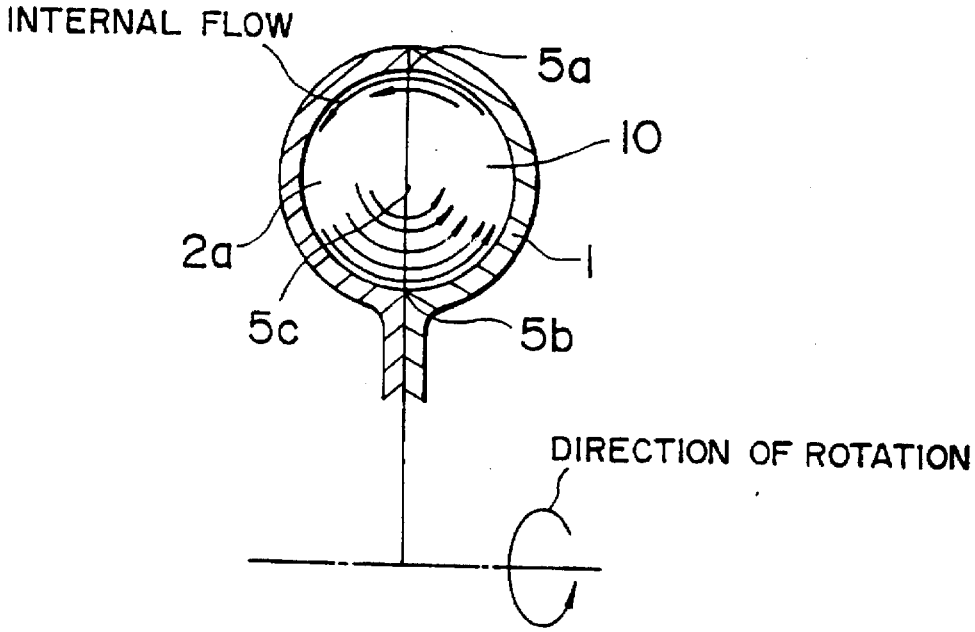
FIGS. 7–14 illustrate the internal flow in an impeller.
Figure 8:
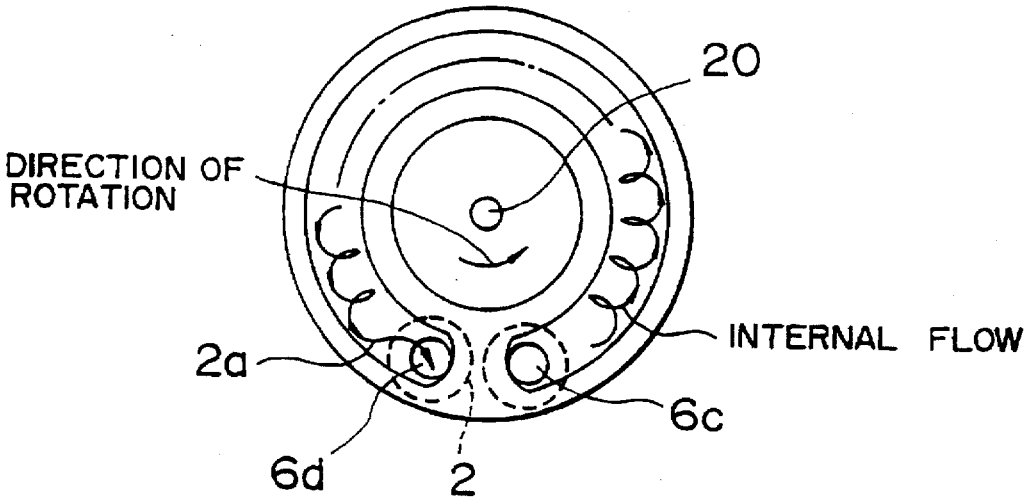
Figure 9:
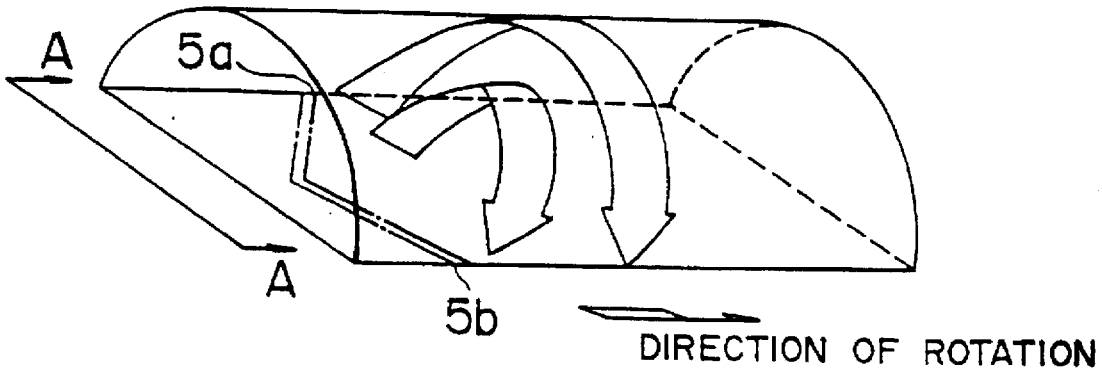

The air flow in the annular passage 8 will be described before explaining about the shape of the blade 5, the air flow in the annular passage 8 being shown in FIGS. 7 to 11. Air introduced through an inlet port 6*c* passes, as shown in FIGS. 7 and 8, through a passage 2*a* in the casing 2 formed in the impeller 1, with the passage 2*a* being in the form of a circular cross sectional shape. The air passes through the passage 2*a* while swirling around the center of the circular cross section and the pressure of which is being raised due to the rotation of the blades 5 until the air reaches the outlet port 6*d* through which the air is discharged.

It has been found that air passes as shown in FIG. 9 to 14 as a result of visual tests and measurements of the speed of the internal flow.

Figure 10:
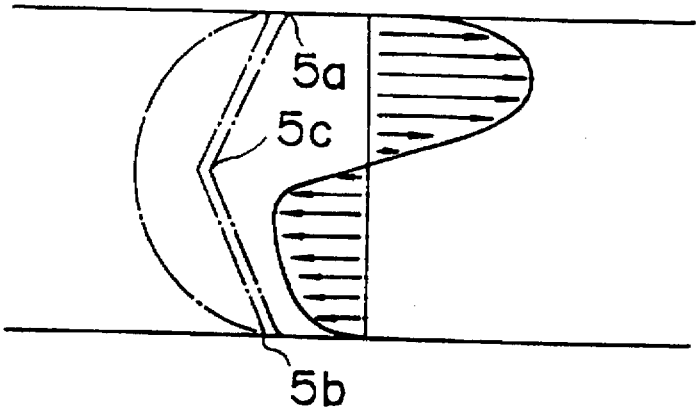

Assuming, as shown in FIGS. 3 to 7, that the inner end of the blade 5 is 5*b*, the outer end of the same is 5*a* and the central portion between the outer end 5*a* and the inner end 5*b* is 5*c*, the distribution of speed of air passing through the annular passage 8 after it has been introduced through the inlet port 6*c* with respect to the speed of the blade 5 becomes as shown in FIG. 10. That is, the speed of internal flow becomes positive with respect to the direction of rotation of the impeller 1 in the region from the outer end 5*a* to a position near the central portion 5*c*, while the space becomes negative values in the region from the position near the central portion 5*c* to the inner end 5*b*.

Therefore, in this embodiment, at least the more the air approaches the central portion 5*c* from the inner end 5*b*, the larger becomes the speed component of air passing through the annular passage 8 in the inverse direction to the direction of the rotation, so that the shape of the blade 5 facing the annular passage 8 is formed to be retracted in the region from the inner portion to the central portion in order that air can flow without separation even when it passes through the portion near the central portion 5*c* at which air passes at high speed.

That is, in this embodiment, angle $\beta_1$ in the circumferential direction is determined so as to retract the blade 5 to the central portion 5*c* at the inner portion thereof, thereby making the internal flow uniform.

Figure 11:
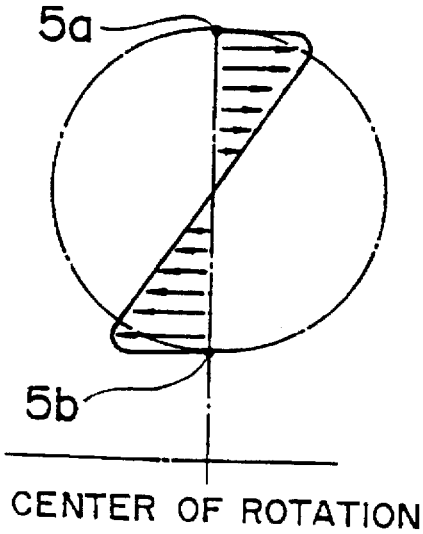

On the other hand, as is known, the speed distribution of the flow passing through the annular passage 8 in the transverse direction toward the rotational shaft 3 has, as shown in FIG. 11, speed vector running toward the casing 2 in a region from the outer end 5*a* to a position near the central portion 5*c*, and it has speed vector running toward the impeller 1 in the region from the position near the central portion 5*c* to the inner end 5*b*.

Figure 14:
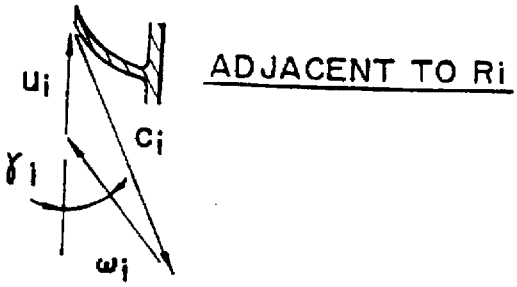

Therefore, in this embodiment, the axial inlet angle of the blade 5 is determined so as to be adapted to the resultant vector of the speed vector of the air passing through the annular passage 8 with respect to the blade 5 as shown in FIG. 10 and the speed vector of the air passing in the transverse direction toward the rotational shaft 3 with respect to the blade as shown in FIG. 11, that is, the vector $_{\gamma}1$ in the speed triangle shown in FIG. 14.

That is, the resultant speed vector changes in such a manner that the inlet angle of the front edge of the blade 5 is about 90° at the inner end 5*b* and it becomes smaller in going toward the central portion 5*c*, so that the axial inlet angle is determined to be adapted to this change.

Figure 2:
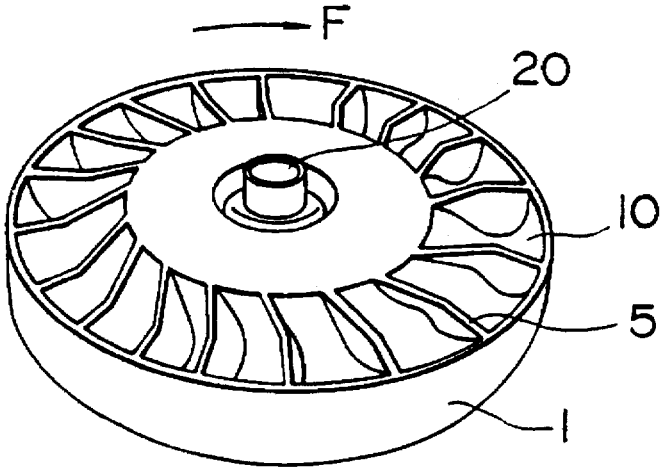
FIG. 2 is a perspective view which illustrates an impeller of the vortex flow blower shown in FIG. 1.
Figure 3:
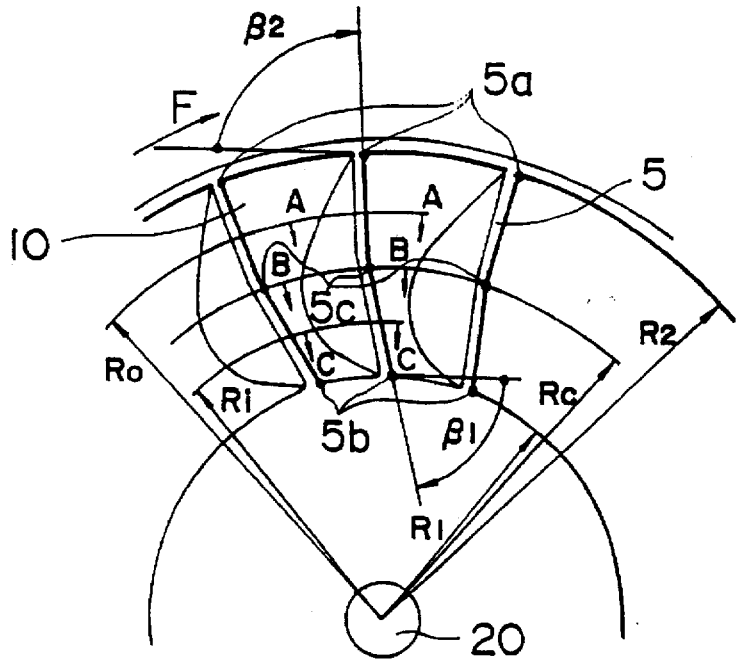
FIG. 3 is an enlarged plan view of a part of the impeller shown in FIG. 3.
Figure 4:
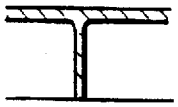
FIGS. 4–6 are cross sectional views respectively taken along lines A—A, B—B and C—C of FIG. 3.
Figure 5:
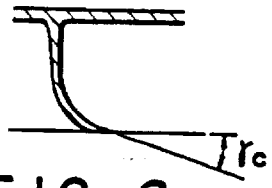
Figure 6:
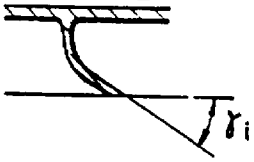

Referring to FIG. 2, a shaft hole 20 for fastening the rotational shaft 3 is formed in a central portion of the impeller 1. As shown in FIG. 3, the impeller 1 has blades 5 and passages 10 between the blades 5 formed annularly in a space between radii $R_1$ and $R_2$ from the center of the shaft hole 20. In this case, the structure is arranged in such a manner that the cross sectional shape, which is obtained by cutting the passages 10 between the blades 5 with a plane passing through the center of the shaft hole 20, forms a semicircular arc.

The cross sectional shape of the blade 5 is formed so as to be adapted to the aforesaid resultant speed vector of air in such a manner, for example, as shown in FIGS. 2 to 6.

It is assumed, as shown in FIGS. 2 to 6, that the radius of a circle connecting the inner end **5*b* of the blade 5 and the center (the rotational center of the rotational shaft 3) of the shaft hole 20 is $R_1$, the radius of a circle connecting the outer end 5*a* and the center of the shaft hole 20 is R2 and the radius of the midpoint between the inner end 5*b* and the outer end 5*b* is $R_c$ and, under this assumption, position 5*c* of point $R_c$ in the front edge of the blade 5 is delayed from the inner end 5*b* when viewed in the direction of rotation of the blade 5. Further, it is assumed that the inlet angle at the inner end 5*b* of the blade 5 is γ1 and the inlet angle at the position 5*c* is $\gamma_c$, both $\gamma_1$ and $\gamma_c$ being less than 90° and having the different values from each other with a relationship of $\gamma_1>\gamma_c$ held and, under this assumption, the blade 5 is formed by smoothly curved surface. Furthermore, the axial exit angle γ is formed to be 90° in a region from the central portion to the outer portion. In addition, as shown in FIG. 3, the front edge of the blade 5 is formed in such a manner that it is delayed with respect to the direction of the rotation of the impeller 1 in the region from its inner end to a position slightly outer than the midpoint and it extends radially with respect to the center of the shaft hole 20 in the region outer than the above-described region. That is, as shown in FIG. 3, it is arranged in such a manner that the angle $\beta_1$ formed between the line tangent to the inner end 5*b* and the line connecting the midpoint 5*c* and the inner end 5*b* is less than 90° and the angle $\beta_2$ formed between the line tangent to the outer end 5*a* and the line connecting the midpoint 5*c* and the outer end 5*b*** is 90°. The reason for this lies in that the direction of air flow is inverted at a portion slightly out from the central portion.

The axial angle "γ" is defined, here, to be an angle formed by the smoothly curved surface in the rotational direction side of the front edge portion of the blade 5 with respect to the plane in the front edge of the blade 5. Alternatively, it may be defined with respect to the center line of the cross section of the blade 5.

The angle β in the circumferential direction is defined to be an angle which is in the opposite direction to the direction of rotation, among the angles formed at the intersections between concentric circles with respect to the axial center of the impeller 1 and the front edge of the blade 5 between the lines tangent to the above-described circles and the above-described front edge.

By forming the shape of the blade 5 in this manner, air passes through the inside portion of the casing 2 while swirling from the outer portion of the annular passage 8 formed in the casing 2 before being introduced into the inner portion of the impeller 1 along the surface of the blade 5 in the casing 2, thereby forming an internal flow passing smoothly and three dimensionally along the surface of the blade 5 without any significant speed reduction. That is, since air is introduced so as to be adapted to the inlet flow including the counter flow component in the circumferential direction, the air flow can be introduced between the blades 5 with the resistance reduced satisfactorily. The air which has reached the outer portion changes in its flowing direction due to the axial exit angle of 90°, so that the direction of the internal flow is changed into the forward direction with respect to the circumferential direction and, as a result, the work is imparted to the fluid from the blade 5 by one swirl, thereby causing the pressure of air to be raised. In this manner, a smooth internal flow passing along the blade 5 can be formed three dimensionally in at least the inside portion without any significant speed reduction, so that a flow having no excessive swirls and stagnation can be created. As a result, the discharge pressure can be increased and a vortex flow blower whose noise is low can be obtained.

FIG. 15 illustrates the ratios between the pressure coefficients in the present invention and those of the conventional example when the value of $\beta_1$ of the impeller 1 according to the present invention is varied as 100, 90, 80, 60, 45 and 20 degrees and that of γ of the same is varied as 10, 20, 45, 70, 80 and 90 degrees. The pressure coefficient $\Phi_0$ of the conventional example is obtained when all of $\beta_1$, $\beta_2$, $\gamma_i$, $\gamma_c$ and $\gamma_0$ are 90°. The value of $\gamma_c$ when obtaining the pressure coefficient Φ in an embodiment of the present invention was set to a value which is smaller than $\gamma_c$ by 13 degrees. The value of $\beta_2$ was fixed to 90° and the value of $R_1/R_2$ to a constant value of 0.58.

If the values in the frame are larger than 1.0, it means that the pressure coefficient is higher than that of the conventional example. If it is somewhat larger than 1.7, the pressure coefficient corresponds to 14 or more.

Therefore, the pressure coefficient can be increased to a value greater than 14 when $\beta_1$ is 45 to 80 degrees, $\gamma_i$ by 13 degrees.

Similarly to FIG. 15, FIG. 16 illustrates the values of the pressure coefficient ratio when the value of $\beta_2$ was set to 70 degrees. As shown in FIG. 16, the pressure coefficient ratio obtainable when $\beta_2$ is 70 degrees less than that when $\beta_2$ is 90 degrees. However, the pressure coefficient in this case is larger than that according to the conventional example when $\beta_1$ is 45 to 80 degrees, γi is 20 to 70 degrees, and $\gamma_c$ is smaller than $\gamma_i$ by 13°.

That is, a fact is shown that the axial inlet angle, and the inlet angle in the circumferential direction of the front edge of the blade 5 are critical factors of the aerodynamic performance.

Figure 17:
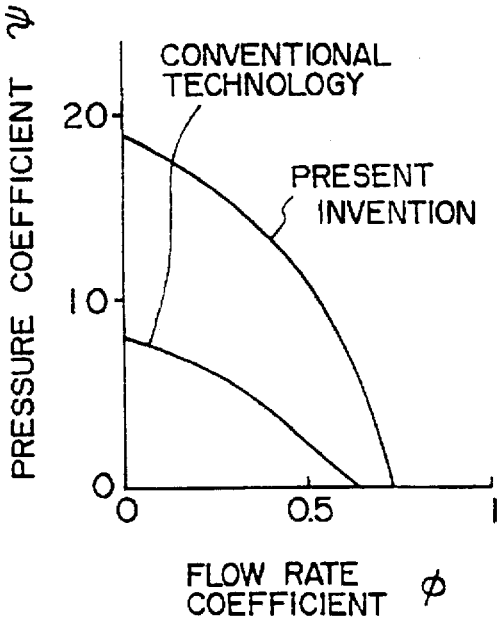
FIG. 17 illustrates the relationship between the flow rate coefficient and the pressure coefficient in the embodiment of the present invention in comparison with that in the conventional vortex flow blower.

FIG. 17 illustrate the relationship between the flow rate coefficient ϕ and pressure coefficient Φ in each of the embodiment of the present invention and the conventional vortex flow blower. It can be understood that both the flow rate coefficient and the pressure coefficient in the embodiment of the present invention are higher than those in the conventional vortex flow blower.

Figure 18:
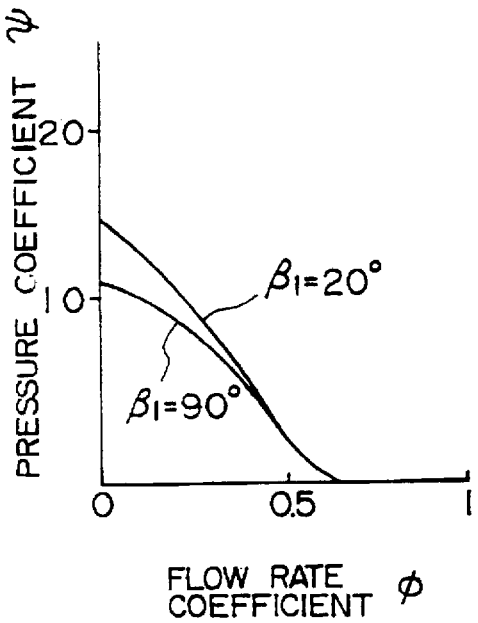
FIG. 18 illustrates the relationship between the flow rate coefficient and the pressure coefficient when the inlet angle in the circumferential direction is selected to be a specific value.

FIG. 18 illustrates the relationship between the flow rate coefficient ϕ and the pressure coefficient Φ when the inlet angle $\beta_1$ in the circumferential direction is set to 20 degrees and 90 degrees. As seen from this drawing, both the flow rate coefficient and the pressure coefficient are higher when the inlet angle $\beta_1$ in the circumferential direction is set to 20 degrees.

Figure 19:
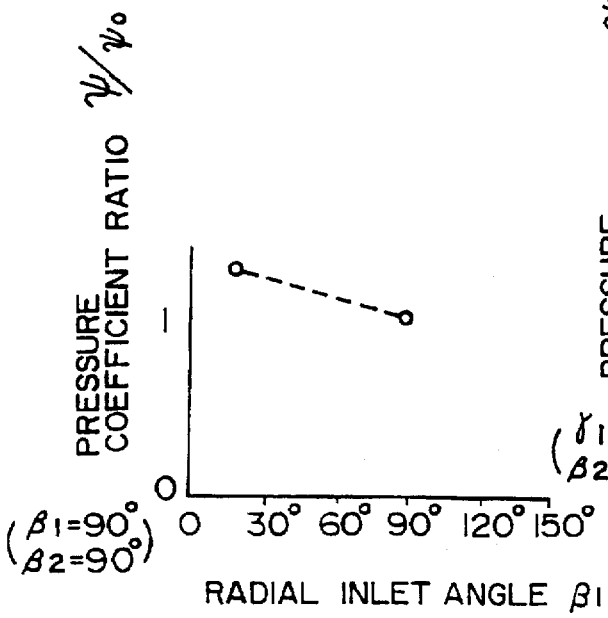
FIG. 19 illustrates the pressure coefficient ratio when the angle in the circumferential direction is changed.

FIG. 19 illustrates the ratios of the pressure coefficients when the inlet angle $\beta_1$ in the circumferential direction is varied. In this case, the exit angle $\beta_2$ in the circumferential direction is fixed to 90 degrees and they are compared with the case in which both $\beta_1$ and $\beta_2$ are 90 degrees. As shown in FIG. 19 the range from 90 degrees to 20 degrees the lesser the value of $\beta_1$ is, the larger becomes the pressure coefficient ratio.

Figure 20:
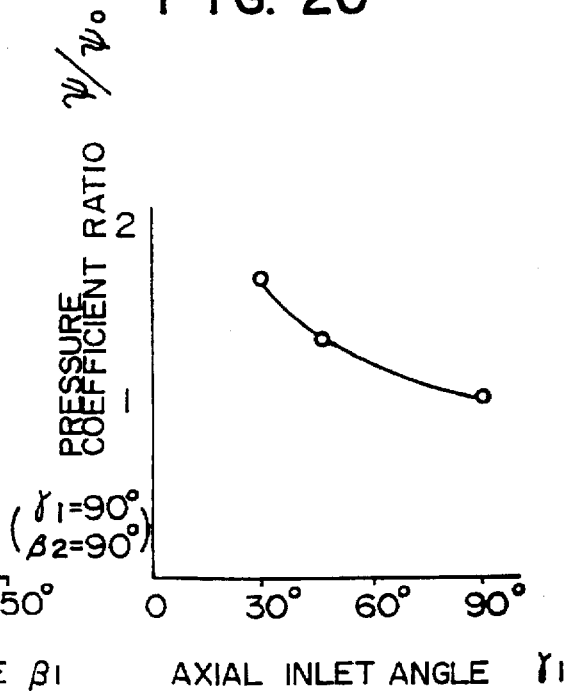
FIG. 20 illustrates the pressure coefficient ratio when the axial inlet angle is changed.
Figure 21:
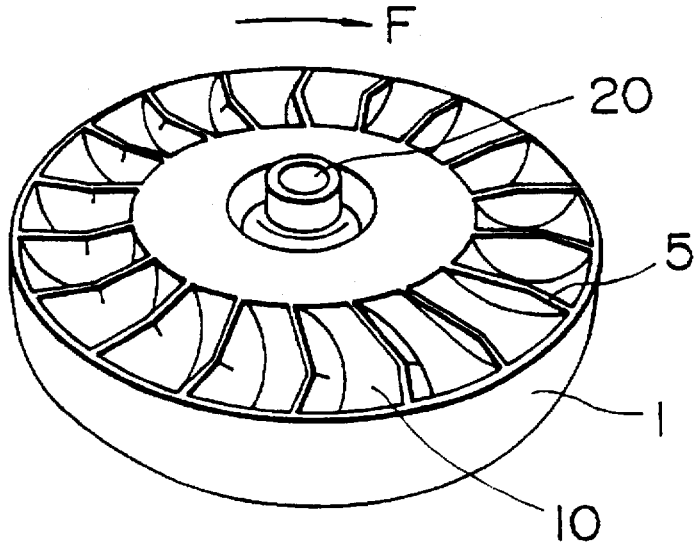
FIGS. 21 to 33 illustrate another embodiment of the present invention, where.
Figure 22:
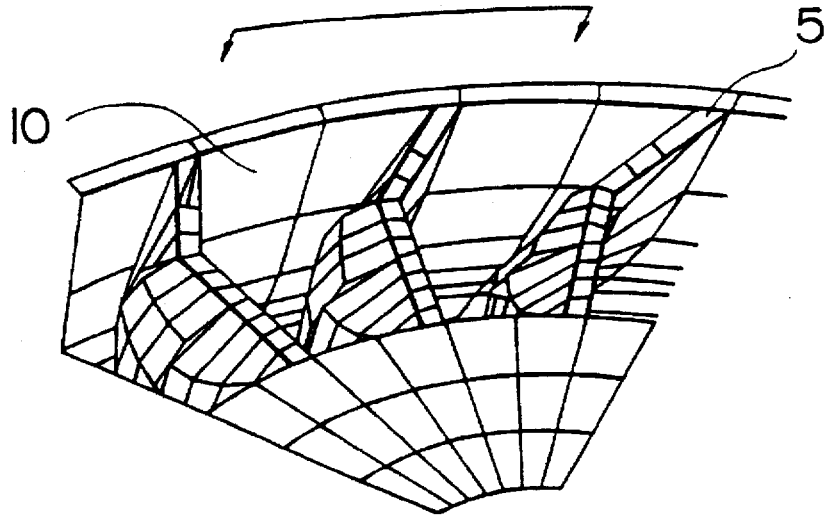

FIG. 20 illustrates the ratios of the pressure coefficients where the axial inlet angle $\gamma_1$ in the front edge of the blade 5 is varied with both $\beta_1$ and $\beta_2$ set to 90 degrees, as a standard in the case where both $\gamma_1$ and $\beta_2$ is set to 90 degrees. As shown in FIG. 20 the lesser the value of $\gamma_1$ is, the larger the pressure coefficient ratio.

As described above, at least the axial inlet angle in the inner portion in the front edge of the blade 5 and the inlet angle in the circumferential direction are determined to be adapted to the resultant vector of the speed vector of the air flow passing through the annular passage 8 and the speed vector of the air flow passing in the traversing direction toward the rotational shaft in the annular passage 8 and thereby form the three dimensionally shaped blades. Therefore, turbulence of the internal flow such as swirls and stagnation of air introduced into the internal portion can be satisfactorily prevented and, as a result, the aerodynamic performance can be significantly improved in comparison with the conventional vortex flow blower. That is, an advantage can be obtained in that the aerodynamic performance can be significantly improved by forming the inner portion of the blade into a three dimensional shape which can be adapted to the flow of fluid. As a result, the drawback inherent in the conventional vortex flow blower in that the pressure coefficient is inevitably reduced when the ratio $R_1/R_2$ is reduced to 0.75 or less for the purpose of reducing the size of the vortex flow blower can be overcome. Therefore, even if the ratio $R_1/R_2$ is set to 0.75 or less and 0.3 or more, the discharge pressure can be significantly increased in comparison with the conventional vortex flow blower and, as a result, an advantage can be obtained in that the outer diameter of the impeller can be reduced and the size of the vortex flow blower can thereby be reduced.

In the embodiment of FIGS. 21–35, the shape of the blade 5 from the inner portion to the central portion thereof is formed as shown in FIGS. 2 and 3. Further, as described above, the speed distribution of air with respect to the speed of the blade 5 in the annular passage 8 becomes, as shown in FIG. 10, positive with respect to the direction of the rotation of the impeller 1 and, in the portion from the central portion 5c to the outer end 5a, the speed component in the annular passage 8 becomes steeply increased in the forward direction with respect to the direction of the rotation of the blades 5. Therefore, the shape of the blade facing the annular passage 8 is formed to project from the central portion 5c to the outer end 5a in the direction of the rotation of the blade 5.

That is, in this embodiment, the exit angle $\beta_2$ in the circumferential direction is determined to 90° or more in order to make the air flow on the outer Side uniform by forming the blade 5 in such a manner that it projects from its central portion 5c toward the outer end 5a.

Figure 12:
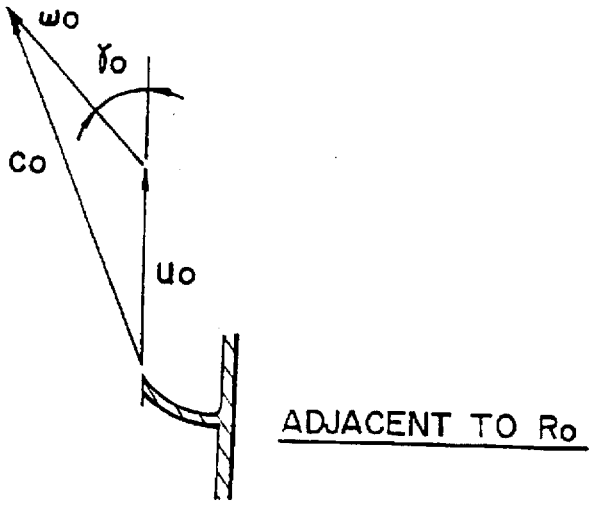
Figure 13:
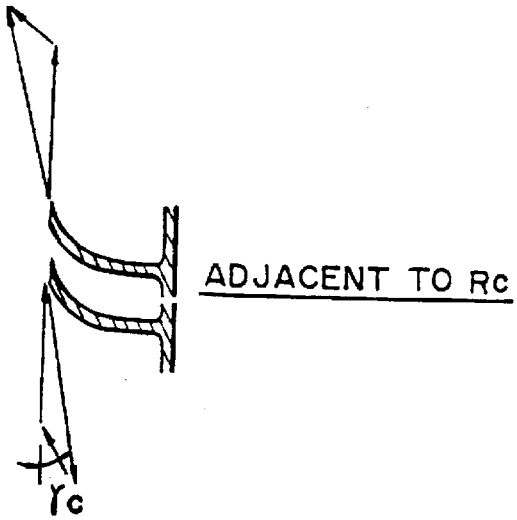

On the other hand, as mentioned before, the axial outlet angle $\gamma$ is determined to be adapted to the vector $w_o$ in the speed triangle shown in FIG. 12.

Assuming that the inlet angle at the front edge of the blade 5 in the outer midpoint at which the radius is a value expressed by $R_O=(R_2+R_c)/2$ and that in the inner midpoint at which the radius is a value expressed by $R_i=(R_1+R_c)/2$ are respectively $\gamma_0$ and $\gamma_i$ the shape of the blade 5 is formed by smoothly curved surface (see FIGS. 22 to 26) formed in such a manner that both $\gamma_c$ and $\gamma_i$ are less than 90 degrees, and the relationships of $\gamma_0>\gamma_c$ and $\gamma_i>\gamma_c$ are met, as shown in FIGS. 24 to 26 and 27. Air introduced to be adapted to the inlet flow including the counter flow component in the circumferential direction and having reached the outer portion changes the direction of the internal flow into the forward direction between the blades 5 since the axial exit angle $\gamma_0$ is provided. Furthermore, since the exit angle $\beta_2$ in the circumferential direction is provided, the slow speed flow near the midpoint and the high speed flows in the vicinity of the outer and inner ends of the blade 5 can be synchronized with one another. As a result, stagnation causing internal loss can be prevented, the swirling component can be increased and the change in air speed between the blades 5 can be reduced. Since the axial exit angle $\gamma_0$ and the exit angle $\beta_2$ in the circumferential direction are provided as described above, the work obtainable by one swirl of the blade 5 can be greater and the internal loss taking place in the action of the blade 5 can be restricted. As a result, the obtainable pressure can be increased.

The exit angle $\beta_2$ in the circumferential direction causes, between the blades, the flow near the midpoint whose internal speed is slow and the flows in the vicinity of outer and inner ends of the blade 5 whose internal speeds are high to be synchronized with one another. As a result, turbulence of the flow due to stagnation, which causes the internal pressure loss, can be prevented.

As a result of the shape of the blade 5 in which the axial exit angle $\gamma_0$ and the exit angle $\beta_2$ in the circumferential direction are provided, the blade 5 acts to form a three dimensional smooth internal flow whose change in speed can be reduced in the passage 8, so that the aerodynamic performance exhibiting a significantly high pressure can be obtained.

Figure 28:
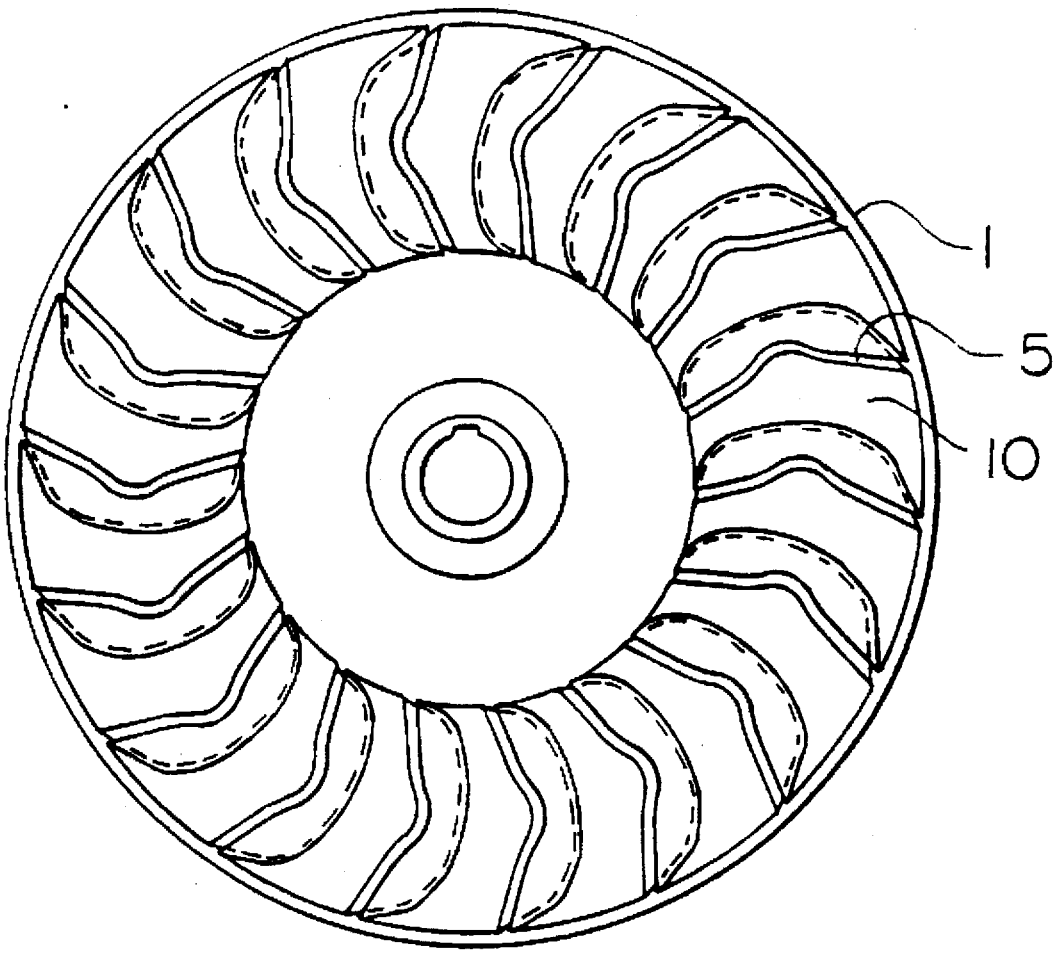
Figure 29A:
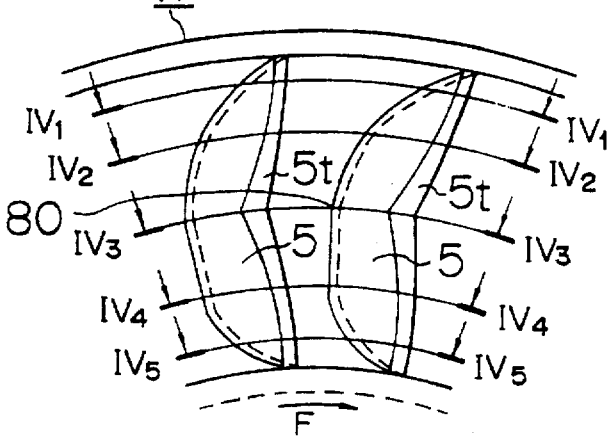
Figure 29B:
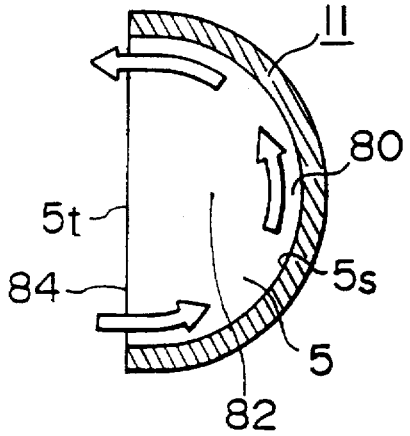
Figure 29C:
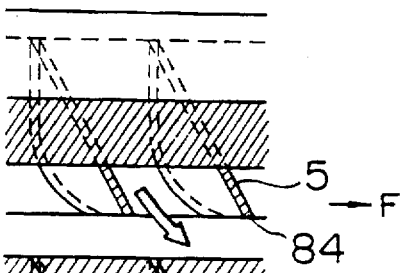
Figure 29D:
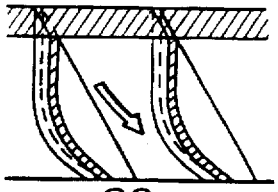
Figure 29E:
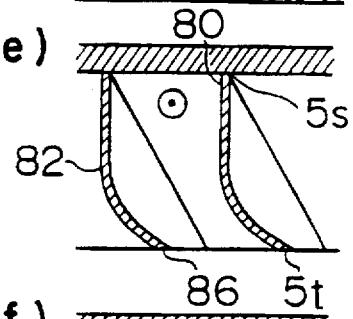
Figure 29F:
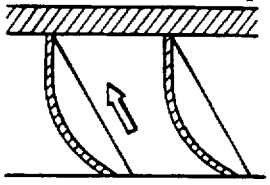
Figure 29G:
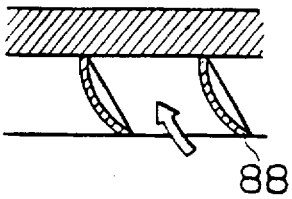
Figure 30A:
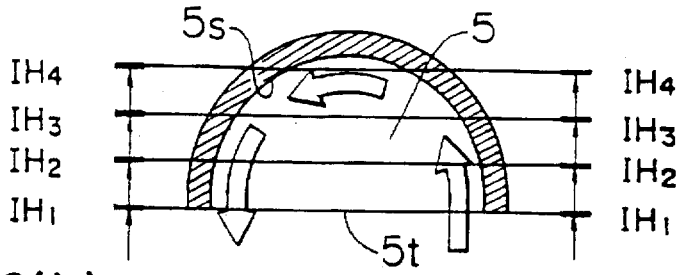
Figure 30B:
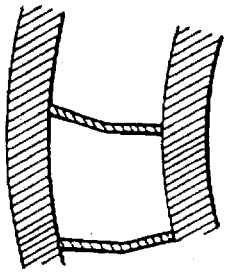
Figure 30C:
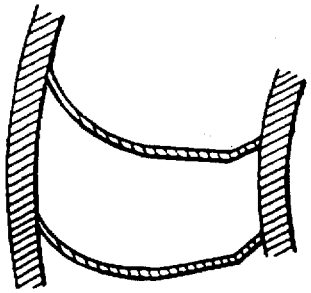
Figure 30D:
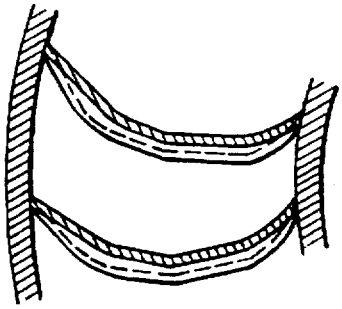
Figure 30E:
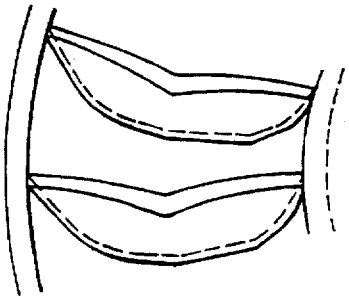

FIGS. 29–36 shown more detailedly the impeller 1 shown in FIGS. 21–27. And, FIG. 28 is a front view of the impeller 1 and FIG. 29 shows a part of the impeller 1 in sections. The impeller 1 is sectioned radially at various positions $IV_1$ and $IV_5$ shown in FIG. 29(*a*) and each section thereof is shown respectively in FIG. 29(*c*)–(*g*) in its circumferentially developed state. Each of the blades 5 constituting the impeller 1 is formed by a three dimensional curved surface. And, the blade 5 has such a shape that its central or middle portion 5c is retracted, with respect to the rotational direction F of the impeller, in comparison with its outer end 5a and inner end 5b. That is, a front edge shape of the blade 5 exhibits a bent, flattened V-shape, so a point 84 in FIG. 29(*a*) and a point 88 in FIG. 29(*g*) are more circumferentially retracted than a point 86 in FIG. 29(*e*). Further, the blade 5 is formed, at its side opposing the casing (i.e., at its opening side 5*t*), so as to be inclined in general with respect to the rotational direction F. On the other hand, at its shroud wall surface side 5*s* the blade 5 is formed so as to be substantially perpendicular to the shroud wall surface at every section [FIG. 29(*c*)–(*g*)].

As shown in FIG. 29(*b*), the inflowing flow (shown with arrow mark) from the inlet port flows into the impeller from its inner side and flows out from its outer side along the shroud wall surface while becoming a swirling flow. Therefore, at sections $IV_4$—$IV_4$ and $IV_5$—$IV_5$ constituting an inflow portion of the flow the blade has a composite shape wherein two inclined surfaces (i.e., a surface inclined with respect to the rotational direction F of the impeller 1 and a surface inclined with respect to a direction perpendicular to the wall surface of the shroud 11) are combined.

The flow flowing into the flow direction converting position from the fluid inflow portion is curved at a substantially right angle in its flow direction. As shown in FIG. 29(*e*), this flow direction converting portion has a portion 80 adjacent the shroud bottom wall surface, which is most remote from the casing, and a cross sectional shape of the passage becomes substantially rectangular [an upper half in FIG. 29(*e*)] because, as mentioned above, at the portion 80 adjacent the shroud bottom wall surface the blade 5 is formed substantially perpendicular to the shroud bottom wall surface. Further, a center portion 82, which is a center of the blade 5 as a whole, is formed substantially right above the portion 80 adjacent the shroud bottom wall surface, i.e., at a side which corresponds to the portion 80 adjacent the shroud bottom wall surface and is more adjacent to the casing.

Further, the fluid outflow portion exists at an outer circumferential side shown in FIG. 29(*c*) and (*d*), and in this portion the blade 5 has at its front edge side such a shape that it is inclined to a side of the rotational direction F of the impeller 1 and is inclined also with respect to a direction perpendicular to the wall surface of the shroud 11.

The above-mentioned fluid inflow portion, flow direction converting portion and fluid outflow portion are formed by a smooth, curved surface.

FIG. 30 shows sections of a part of the impeller 1 radially sectioned at various levels. In the sections at $IH_3$ and $IH_4$ adjacent the shroud bottom wall surface the blade 5 extends perpendicular to the shroud wall surface.

In the impeller 1 having the blades each formed in this manner, three dimensional passages are formed, and the fluid is smoothly introduced into the interblade passage 10 by the fluid inflow portion wherein the blades each have the composite shape wherein two inclined surfaces are combined, and then by the central flow direction converting portion the fluid is guided to a direction perpendicular to the rotational direction of the impeller 1 and, at the same time, in this flow direction converting portion the fluid is accelerated, and thereafter the fluid is smoothly discharged into the annular passage 8 in the casing by the fluid outflow portion with the blades each having the composite shape wherein two inclined surfaces are combined.

In other words, between the neighboring blades 5 the following passages are formed: namely, an inflow passage along the swirling flow between the neighboring blades 5 at the fluid inflow portion, a guide passage at the flow direction converting portion, which guides the fluid introduced by the inflow passage to a direction perpendicular to the rotational direction F of the impeller 1, and an outflow passage between the neighboring blades 5 at the fluid outflow portion, which discharges the fluid guided by the guide passage to a direction along the swirling flow. Moreover, these passages, i.e., the inflow passage, guide passage, guide passage and outflow passage, are formed in a smoothly continuous state.

Figure 31A:
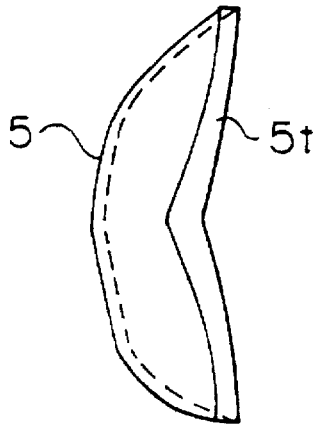
Figure 31B:
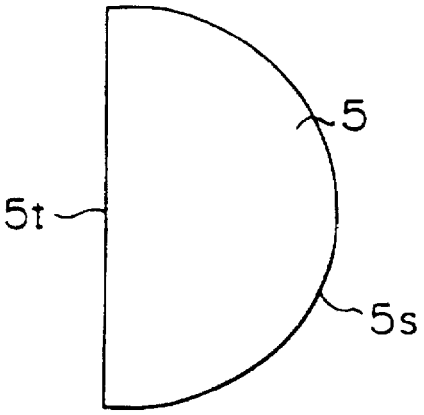
Figure 31C:
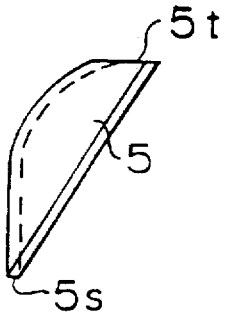
Figure 32:
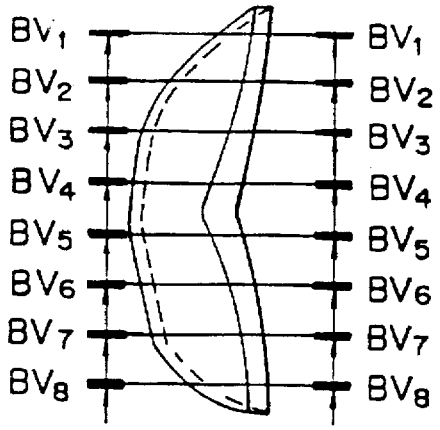
Figure 33A:
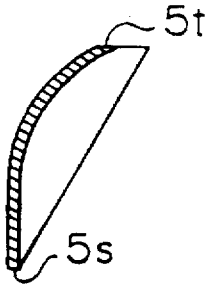
Figure 33B:
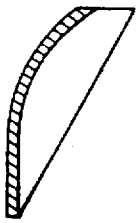
Figure 33C:
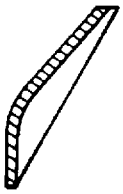
Figure 33D:
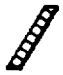
Figure 33E:
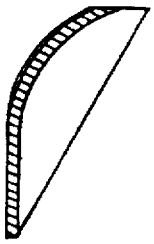
Figure 33F:
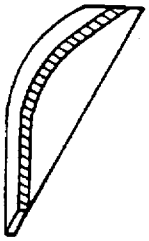
Figure 33G:
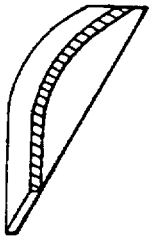
Figure 33H:
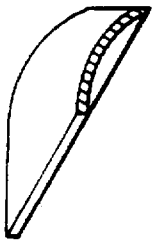
Figure 34:
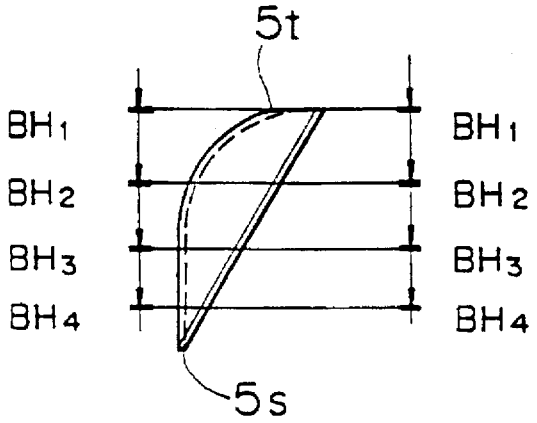
FIG. 34 is a view showing various positions at which the blade shown in FIG. 31 is sectioned in the direction of its height, i.e. from its front edge to its shroud bottom side.
Figure 35A:
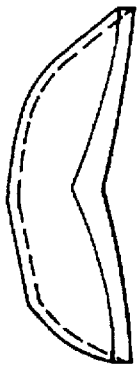
FIGS. 35(*a*), 35(*b*), 35(*c*), and 35(*d*) are sectional views of the blade sectioned at the respective positions $BH_1$—$BH_1$, $BH_2$—$BH_2$, $BH_3$—$BH_3$, and $BH_4$—$BH_4$ shown in FIG. 34.
Figure 35B:
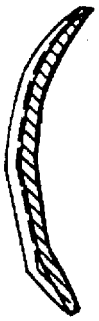
Figure 35C:
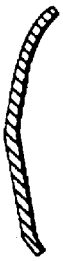
Figure 35D:
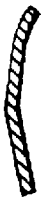

A shape of single blade 5 is shown in FIGS. 31–35. FIG. 31(*a*) is a side view of the blade, FIG. 31(*b*) is a front view thereof and FIG. 31(*c*) is a plan view thereof. FIG. 32 shows radially various positions at which the blade is sectioned, and FIG. 33 shows sectional shapes thereof. This blade is one which is used in the impeller 1 shown in FIGS. 28–30. FIG. 34 shows various positions at which the blade 5 shown in FIG. 31 is sectioned in the direction of its height, i.e., from its front edge to its shroud bottom side, and FIG. 35 detailedly shows sectional shapes thereof.

Figure 36:
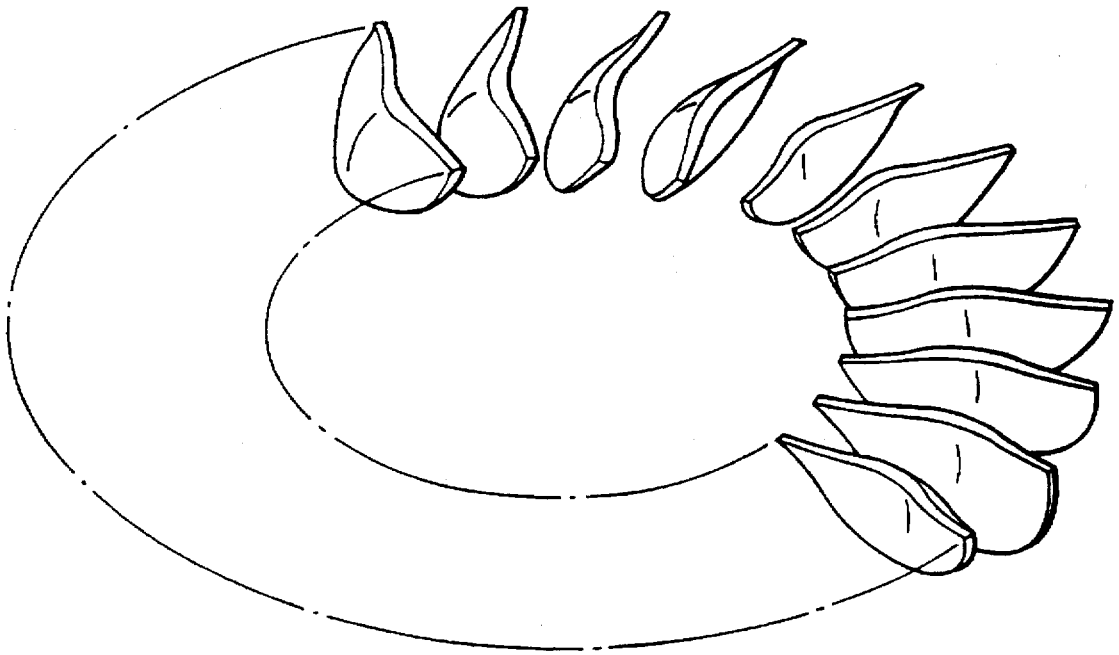
FIG. 36 is a perspective view showing the arrangement of the blades.
Figure 37:
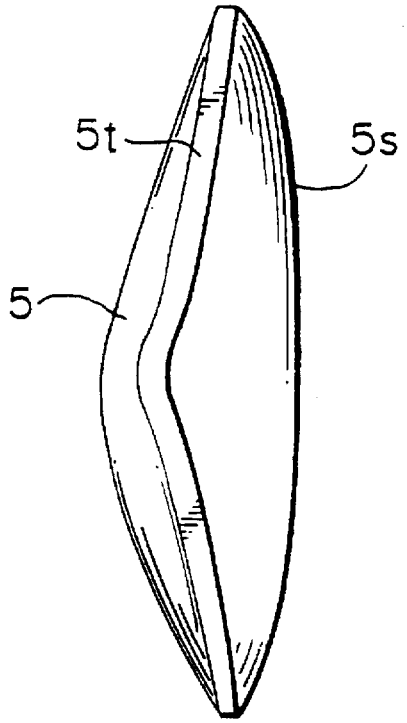
FIG. 37 is a perspective view of the blade seen from a substantially upper-front side.
Figure 38:
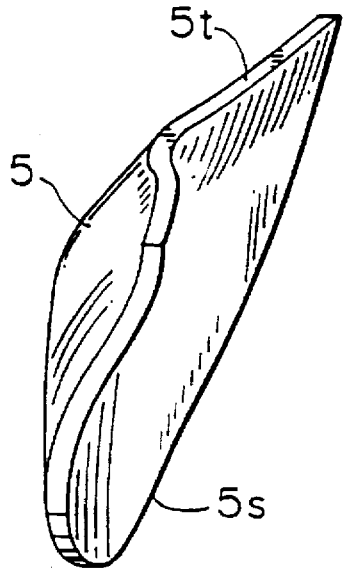
FIG. 38 is a perspective view of the blade seen from an upper-lateral side.

FIG. 36 shows an aspect of the impeller 1 shown in FIG. 28, from which the shroud has been removed. Further, FIG. 37 is a perspective view of a single blade 5 seen from a substantially upper-front side, and FIG. 38 is a perspective view of the blade 5 seen from a upper-lateral side. Adjacent the shroud wall surface, the blade is perpendicular to the shroud wall surface.

Figure 39:
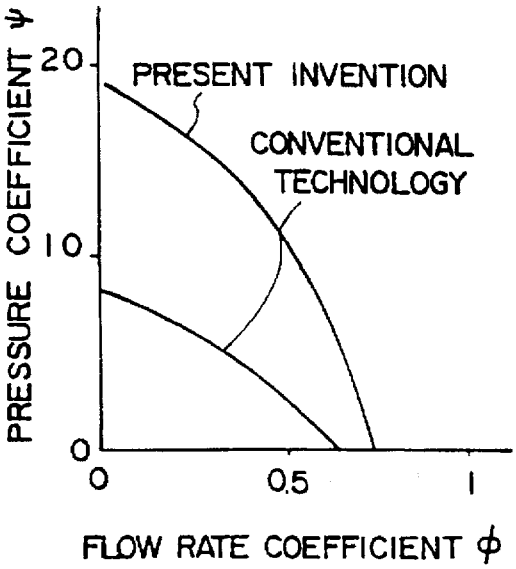
FIG. 39 illustrates test data of the embodiment according to the present invention in comparison with those of the conventional technology.
Figure 40:
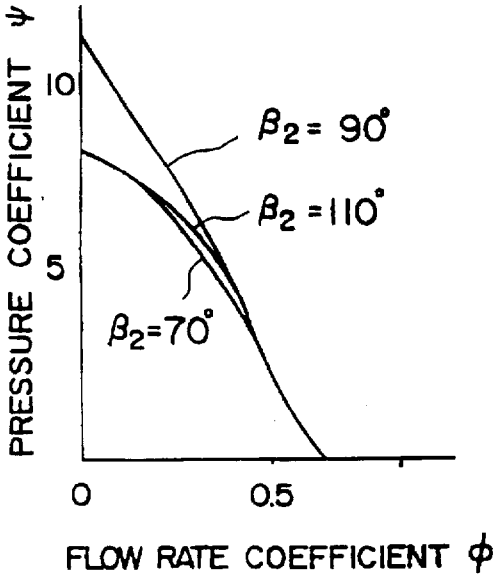
FIG. 40 illustrates the relationship between the flow rate coefficient and the pressure coefficient in the conventional technology in which only $\beta_2$ is changed.
Figure 41:
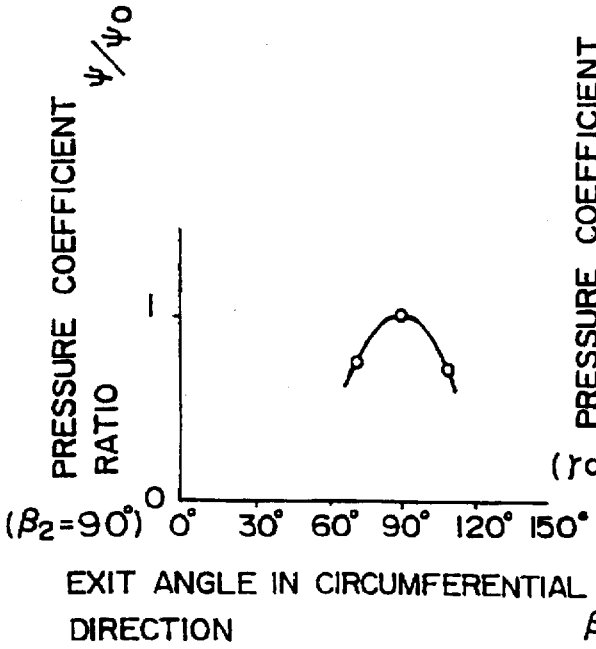
FIG. 41 illustrates the pressure coefficient ratio with respect to the case where $\beta_2$=90° at the time where the flow rate coefficient, shown in FIG. 29, is 0 (i.e., in closed state)
Figure 42:
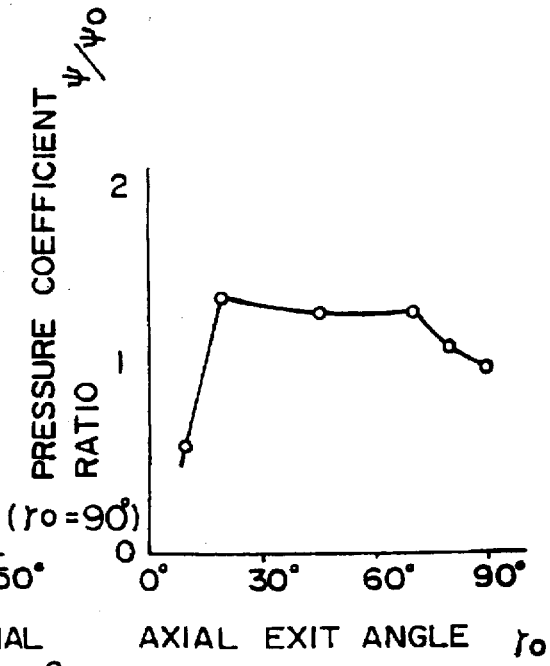
FIG. 42 illustrates the pressure coefficient ratio obtained from test data and with respect to the case where $\beta_2$=90° and $\gamma_0$=90° at the time where the flow rate coefficient is 0 (i.e., in closed state) when the axial exit angle $\gamma_0$ is changed.

The experimental results of the blade 5 whose outer shape is three dimensionally formed are shown in FIG. 39 in comparison with the conventional vortex flow blower in which the shape of blade is set in such a manner that $\beta_1$=90 degrees, $\beta_2$=90 degrees, $\gamma_0$=90 degrees and $R_1/R_2$=0.58. As seen from this drawing, when the outer shape is three dimensionally formed as described above, the pressure coefficient can be improved twice or more. In an experiment involving the vortex flow blower having the conventional two dimensionally formed blade in which only the exit angle $\beta_2$ in the circumferential direction was taken into consideration, as shown in FIGS. 40 to 41, a satisfactory maximum pressure coefficient was displayed when $\beta_2$ was about 90 degrees. However, if the axial exit angle $\gamma_0$ is varied, the pressure coefficient becomes larger in comparison with the conventional vortex flow blower. Because of the above-described reason, with respect to the embodiment shown in FIG. 23, the pressure coefficient can be significantly improved by simultaneously changing the axial exit angle $\gamma_0$ to 45 degrees and the exit angle $\beta_2$ in the circumferential direction to 115 degrees.

Figures 43, 44:
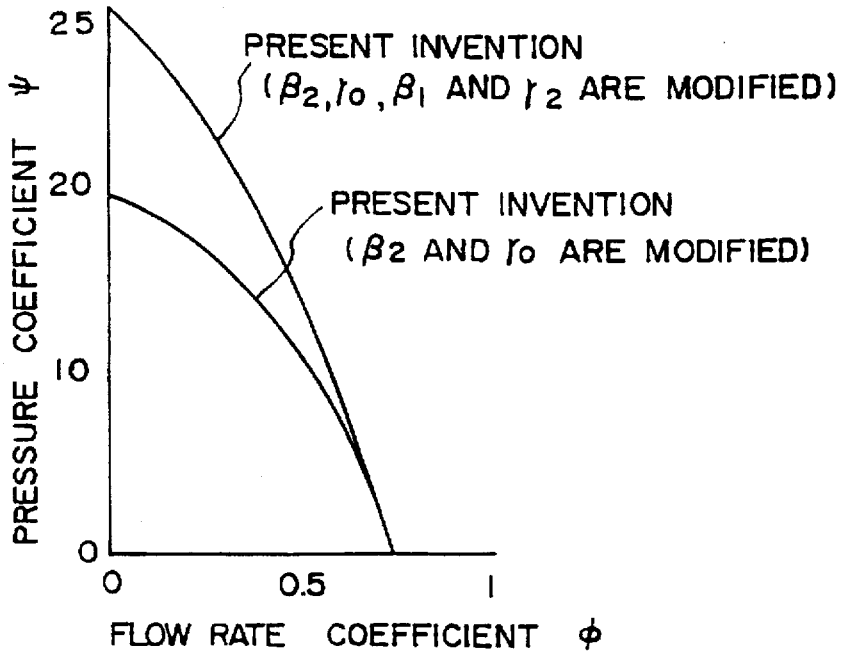
FIG. 43 illustrates the pressure coefficient ratio with respect to the case where $\beta_2$=90° and $\gamma_0$=90° at the time where the flow rate coefficient is 0 when the exit angle in the circumferential direction and the axial exit are changed.
FIG. 44 illustrates the relationship between the flow rate coefficient and the pressure coefficient in the case where $\beta_1$ and $\gamma_i$ in the inner portion are modified, in addition to $\beta_2$ and $\gamma_0$ in the outer portion, as in the embodiment shown in FIG. 1 and in the case where only $\beta_2$ and $\gamma_0$ in the outer portion are modified.

FIG. 43 is a map showing the pressure coefficient ratios when the axial exit angle $\gamma_0$ and the exit angle $\beta_2$ in the circumferential direction are varied. As seen from this map, the pressure coefficient ratio can be significantly improved in the regions of $100° \leqq \beta_2 \leqq 135°$ and $20° \leqq \gamma_0 \leqq 70°$.

Figure 23:
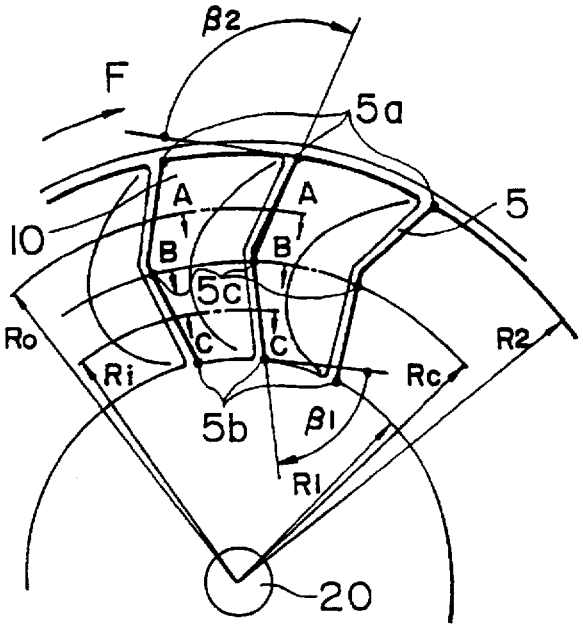
Figure 24:
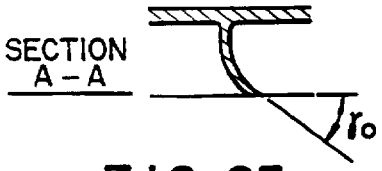
Figure 25:
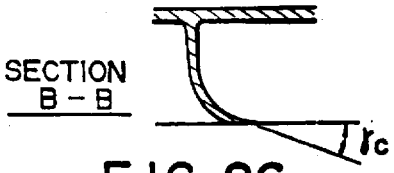
Figure 26:
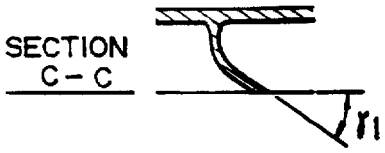
Figure 27:
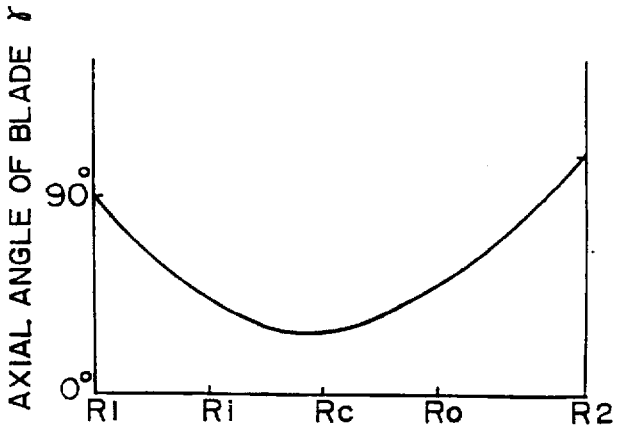

FIG. 44 is a graph which illustrates the experimental results when the outer portion of the blade 5 is three dimensionally formed in addition to the inner portion of the same which has been three dimensionally formed. As shown in FIG. 23, the pressure coefficient can be further improved by three dimensionally forming the blade 5 as a whole, thereby making it possible to obtain a pressure coefficient of about 25.

Figure 45:
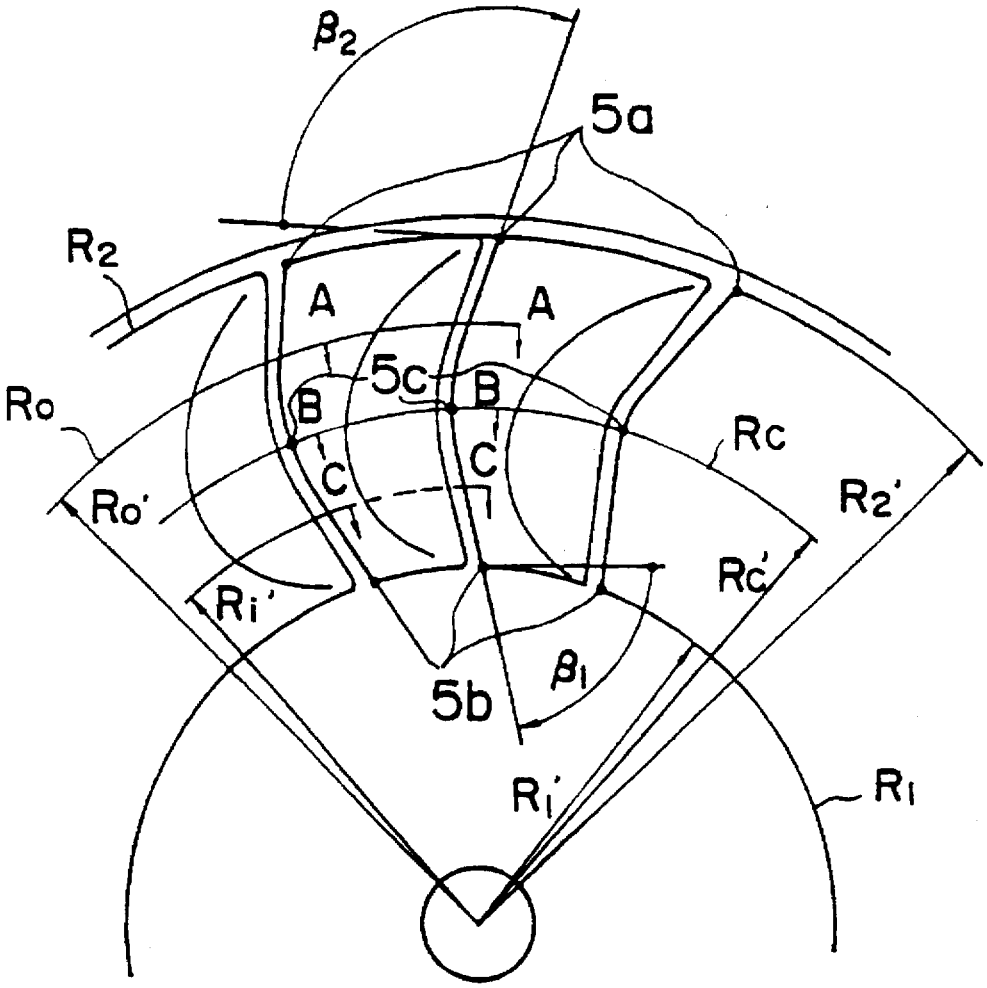
FIG. 45 is a path view which illustrates an another embodiment in which the angle in the circumferential direction of the front edge of the blade is smoothly changed.

In this embodiment, the impeller 1 is, as shown in FIG. 23, arranged to have a blade 5 whose shape at the front edge is formed in such a manner that its central portion 5*c* connecting the inner portion and the outer portion of the blade 5 is steeply changed in its angle, but, as shown in FIG. 45, the shape of the blade may be modified in such a manner that the angle is gradually changed from the inner end 5*b* to the outer end 5*a*.

Figure 46:
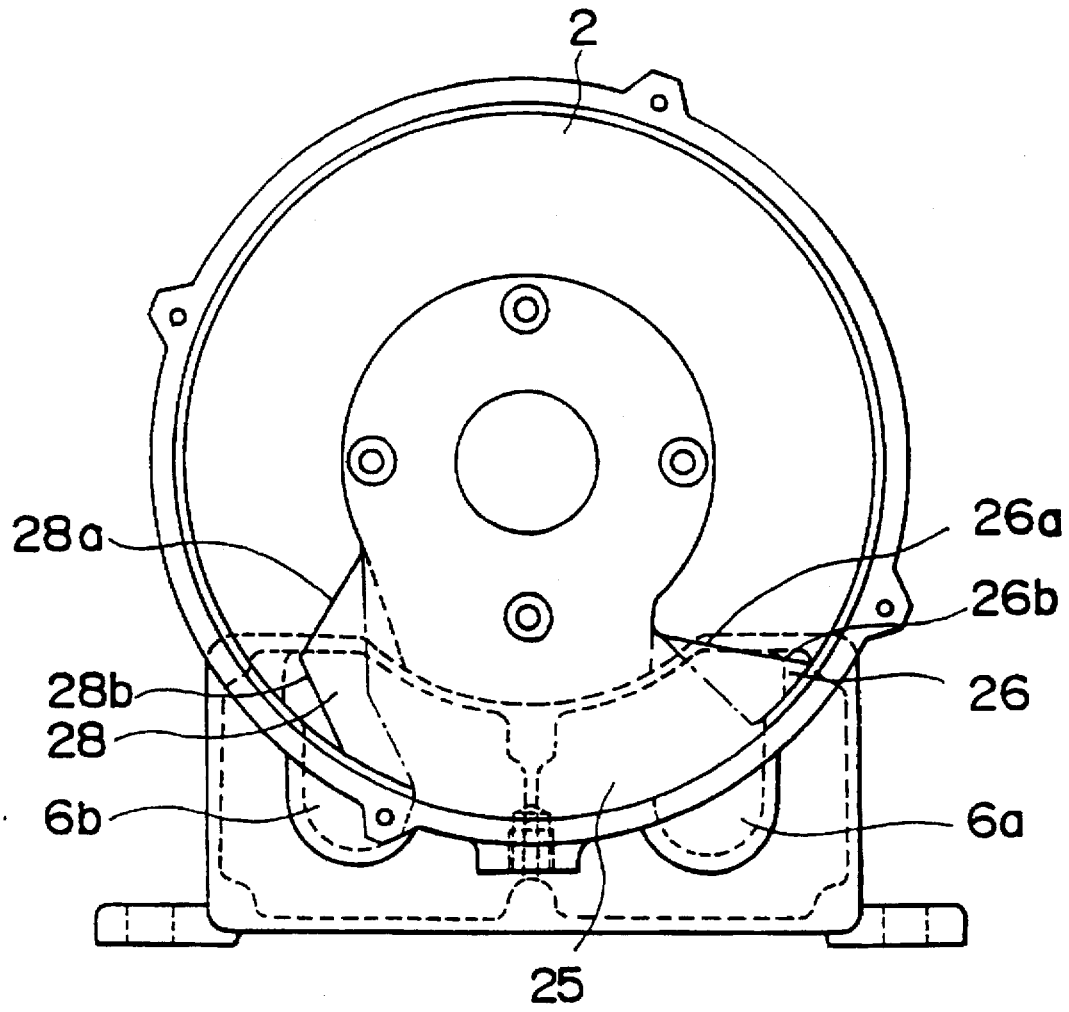
FIG. 46 is a front elevational view which illustrates the shape of a partition wall formed between an inlet port and an outlet port of a casing.

FIG. 46 illustrates the shape of partition wall 25 for partitioning the inlet port and the outlet port formed in the casing 2, the partition wall being capable of significantly eliminating noise. The casing 2 has a circular arc passage 8 whose cross section facing in the direction running parallel to the axial line of the rotational shaft 3 is in the form of a semicircular arc groove. The groove is provided with a partition wall 25 in a part thereof, with the partition wall 25 facing the impeller 1 with a small gap retained there between. An end of the circular arc passage 8 is connected to the inlet side passage 6*a*, and the other end of the same is connected to the discharge side passage 6*b*. The inlet side passage 6*a* and the outlet side passage 6*b*. The inlet side passage 6*a* and the outlet side passage 6*b* run parallel to each other in the muffler 7 which also serves as the base member.

A guide 26, adjacent to the inlet port, is provided in a portion of the partition wall 25 adjacent to the inlet port. A front portion 26*a* of the guide 26, adjacent to the inlet port, is arranged to be substantially horizontal so as to make the blade 5 cut (intersect the front edge of the blade 5) from outside. It is considered that the front portion 26*a* acts to smooth introduced air, which has been introduced into the circular arc passage 8 through the inlet port 6*c*, to the inlet port (the portion in which the arrows face the left hand direction in FIG. 11) of the blade 5. When viewed from the axial direction, the inlet port 6*c* is hidden behind the guide 26 adjacent to the inlet port. This acts to prevent noise generated in the circular arc passage 8 from being directly transmitted to the passage 6a adjacent to the inlet port for the purpose of insulating noise.

A guide 28, adjacent to the outlet port is provided with the partition wall 25 adjacent to the outlet port. The front end 28a of the guide 28 adjacent to the outlet port is formed in such a manner that its substantially central portion 28b (the portion which agrees with a point of the blade 5 at which the flow is inverted) projects in the direction opposite to the direction F of the rotation of the impeller 1 so as to make the blade 5 cut (intersect the front edge of the blade 5) from inside. It is considered that the front end 28a acts to guide air to be discharged from the circular arc passage 8 to the outlet port 6d so as to be smoothly discharged from the outlet portion (the portion in which arrows face the right hand direction in FIG. 11) of the blade 5. Further, when viewed from the axial direction, the outlet port 6d is substantially hidden behind the guide 28 adjacent to the outlet port. This acts to prevent noise generated in the circular arc passage 8 from being directly transmitted to the passage 6b adjacent to the outlet port for the purpose of insulating noise.

Figure 47:
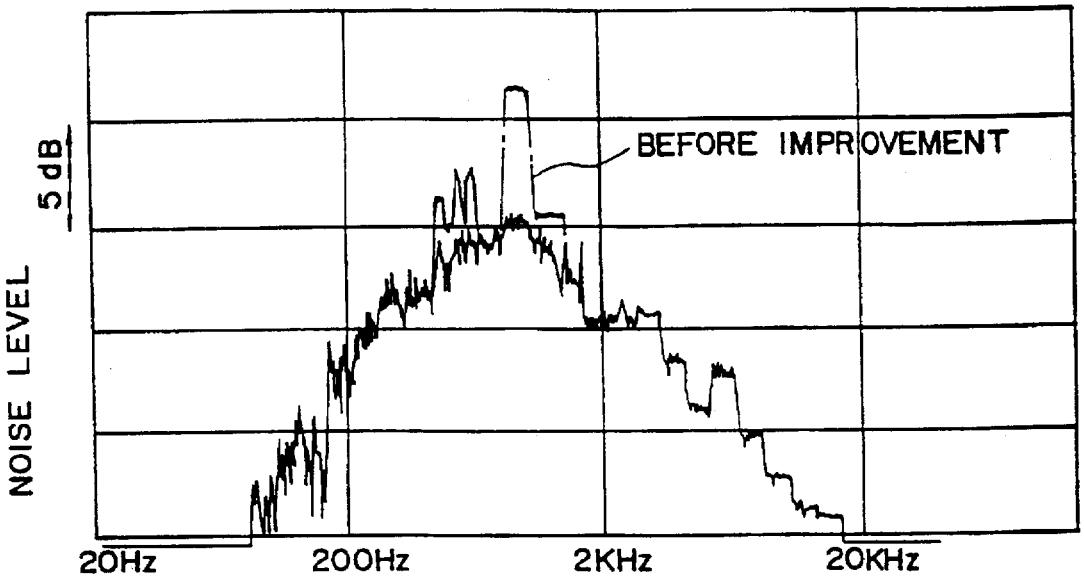
FIG. 47 illustrates noise spectrum of the vortex flow blower.

FIG. 47 is a graph which illustrates data about noise actually measured when a vortex flow blower composed by combining of the casing 2 shown in FIG. 46 and the impeller 1 shown in FIG. 36 is operated.

It can be clearly seen that the guide 28 adjacent to the inlet port and the guide 26 adjacent to the outlet port significantly assist in the reduction of noise when compared with noise data shown in FIG. 47 in the case where the vortex flow blower from which the guide 26 adjacent to the inlet port and the guide 28 have been removed is operated.

In an experiment in which dimension L from 26b to 28b (the portion which agrees with the point of the blade 5 at which the direction of the flow is inverted) in the circular arc passage 8 was selected to meet the following relationship:

$$L=\lambda/4(2n+1)$$

where $\lambda=C/f$ $f=Z\times N$

Z: the number of the blades 5

N: the rotational speed of the shroud

C: acoustic velocity n=0, 1, 2, 3, . . .

the maximum noise level shown in FIG. 47 was further lowered by 4 dB.

Figure 48:
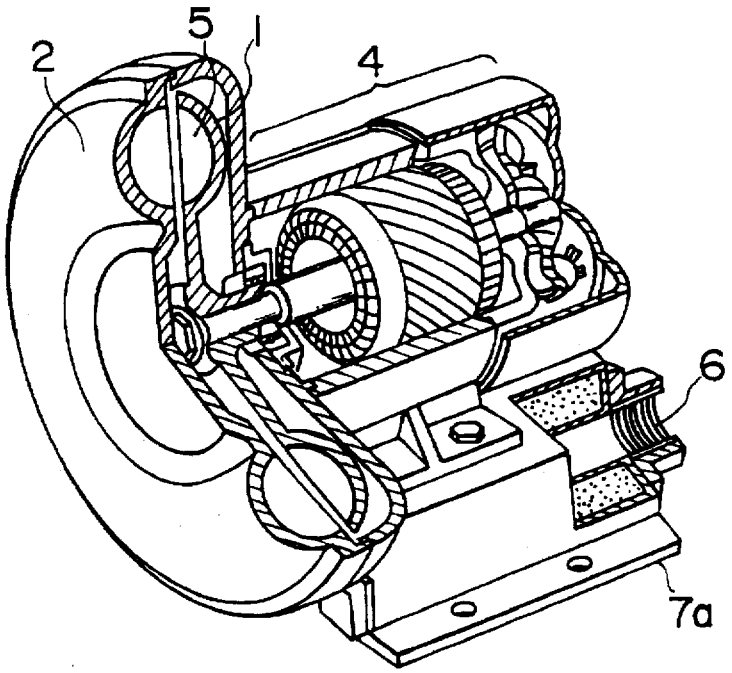
FIG. 48 is a perspective view which illustrates an another embodiment of the present invention.

In the embodiment of FIG. 48, the impeller 1 having the blades 5 is disposed on the side adjacent to the motor 4 and the casing 2 is disposed to face the impeller 1. As a result, the degree of the overhang of the impeller 1 can be reduced. In this manner, since the impeller 1, which is a body of rotation, is disposed adjacent to the bearing portion, vibrations of the impeller 1 can be significantly reduced, thereby causing the durability against the radial loads to be improved.

Figure 49:
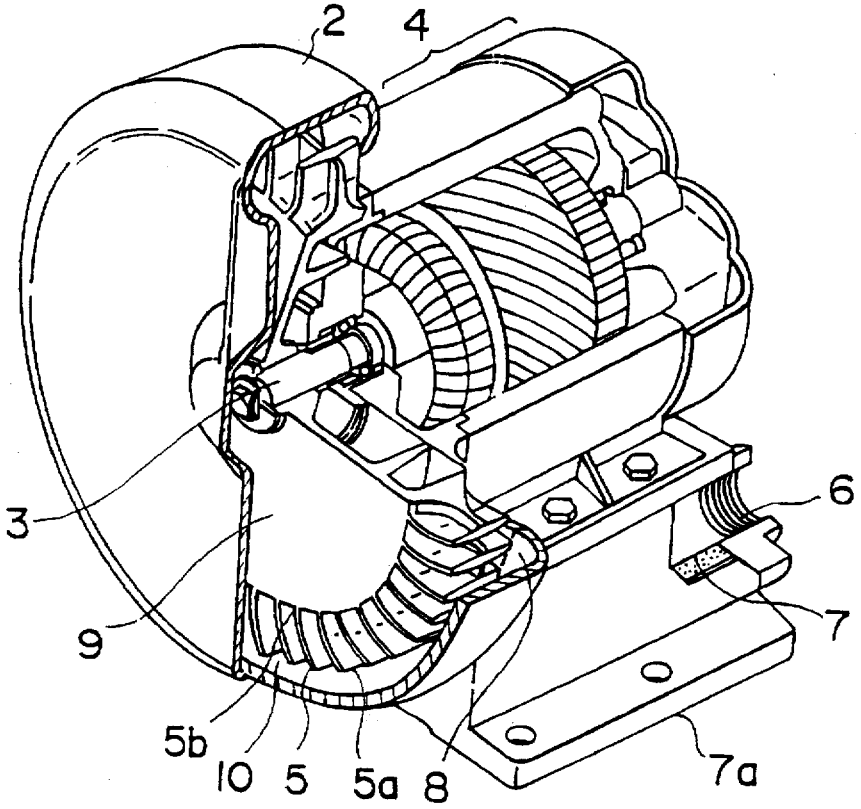
FIGS. 49 to 53 illustrate a further another embodiment of the present invention; where.
Figure 50:
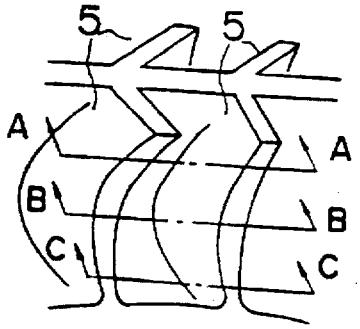
Figure 51:
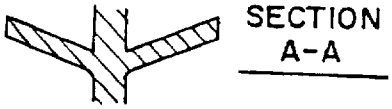
Figure 52:
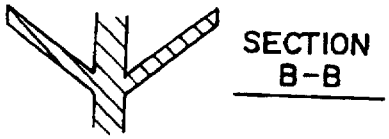
Figure 53:
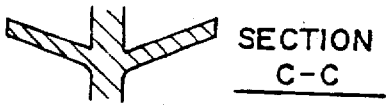

In the embodiment shown in FIGS. 49 to 53, an impeller, which is a double blade impeller having on its both sides the shape of the blade shown in FIGS. 23 to 27, is employed. FIG. 49 is a perspective view which illustrates the vortex flow blower in which the double blade impeller is mounted. In this embodiment, the casing 2 is formed so as to cover the both sides of the double blades. The annular passage 8 is formed on both sides of the double blades. Partition walls are provided on both sides of the casing 2 so as to hinder the communication between the outlet port 6d and the inlet port 6c. The inlet side passage 6a and the outlet side passage 6b are provided adjacent to the motor 4.

By virtue of the last-mentioned features, a vortex flow blower exhibiting a high pressure coefficient and capable of obtaining a large wind quantity can be provided. Furthermore, another effect can be obtained in that the outer diameter of the casing can be reduced and the size of the vortex flow blower can thereby be reduced.

Next, a method of manufacturing an impeller of the vortex flow blower according to the present invention will be described.

Figure 61:
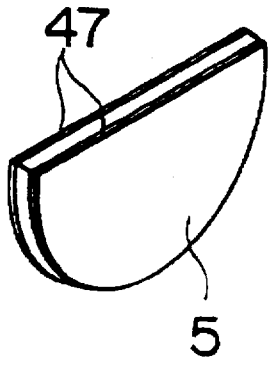
Figure 62:
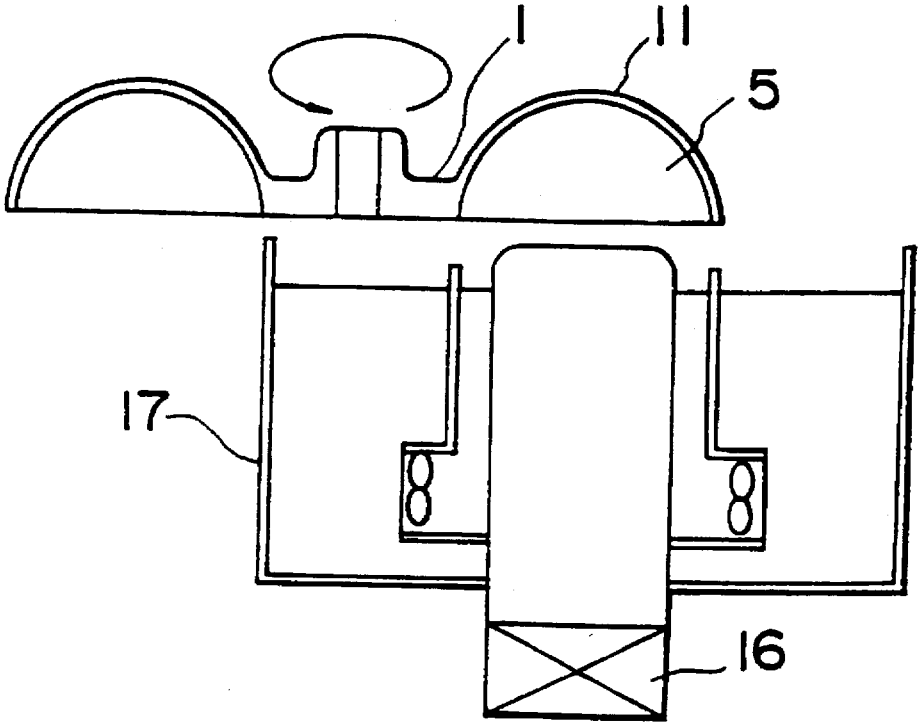
Figure 63:
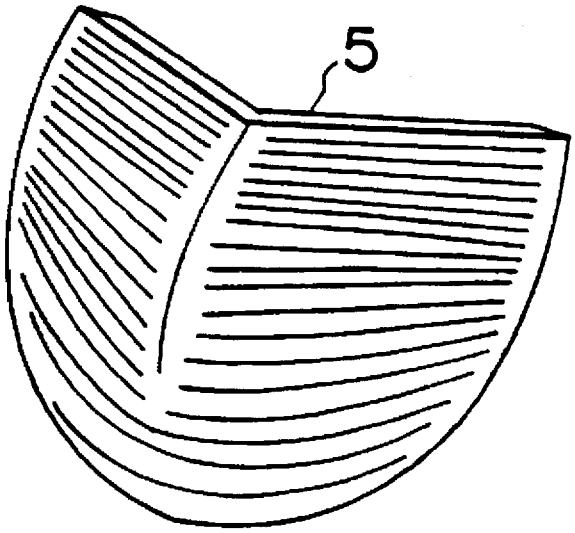

In the embodiment of FIGS. 54 to 62 the blade 5, as shown in FIGS. 63, and the shroud 11 are independently formed. Then, the shroud 11 having the annular groove 45 and a plurality of blades 5 are coupled and secured to each other so that the impeller 1 is manufactured.

In this manner, by forming the blades 5 and the shroud 11 independently, the shroud 11 can be manufactured by using a mold formed two dimensionally, so that it becomes possible to be mass-produced by the die-casting or metal mold casting process. Further, even if the blade 5 is in the form of a complicated shape, it becomes possible to be die-cast or press-formed, so that the impeller having the three dimensionally shaped blades can be easily manufactured.

Further, also in another embodiment described later, the blade 5 can be made of a thin and light weight material since the blades 5 are independently manufactured as described above. Therefore, an effect can be obtained in that the secondary moment of inertia of the impeller can be reduced.

Further, as shown in FIG. 63, since only the blades 5 can be formed to have various shapes, impellers having different aerodynamic performances can be easily manufactured.

Figure 54:
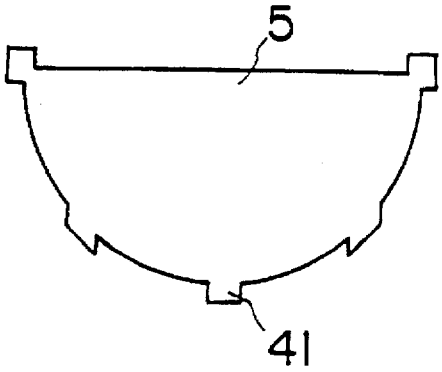
FIGS. 54 to 63 illustrate a method of manufacturing an impeller according to the present invention, where.
Figure 55:
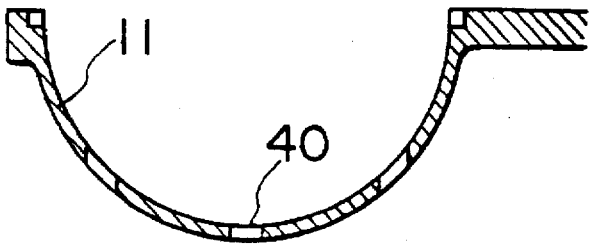

In a manufacturing method shown in FIGS. 54 and 55, the shroud 11, in which the annular groove 45 is formed and a plurality of insertion holes 40 are formed, and the blade 5 provided with a plurality of caulking projections 41 are manufactured. The shroud 11 and the blade 5 are coupled to each other in such a manner that the caulking projections 41 formed on the blade 5 are inserted into the insertion holes 40 formed in the shroud 11, and then they are secured by plastically working the caulking projections 41.

Figure 56:
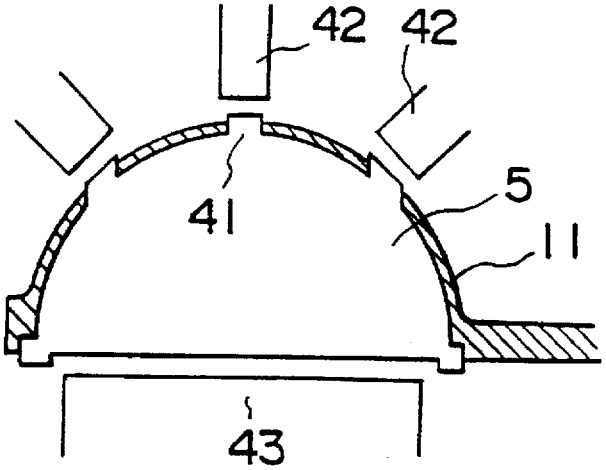

The method of plastically working may be a cold working or a hot working. It is preferable in terms of the appearance after subjected to the plastic working that the following method be employed namely, as shown in FIG. 56, an upper electrode 42 having a predetermined conductivity and high temperature strength and a lower copper electrode 43 are used and only the caulking projections 41 are plastically worked with heat generated by an electric current being applied thereto.

Figure 57:
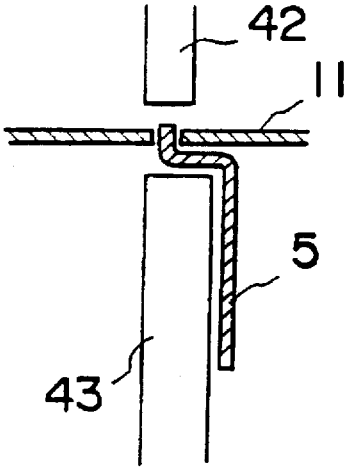

Further, as occasion demands, as shown in FIG. 57 when the impeller is manufactured by fitting the blade 5 within the annular groove 45 formed in the shroud 11 before being press formed, the blade 5 can be stabilized and further satisfactorily plastically deformed at the time of caulking, so that the airtightness between the blades 5 can be also improved.

Figure 58:
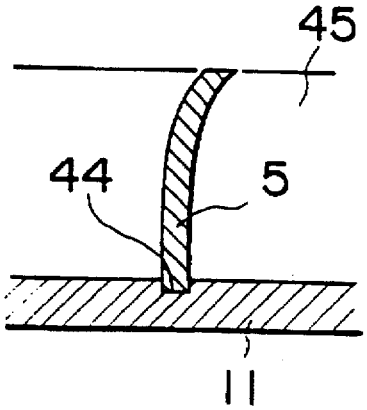
Figure 59:
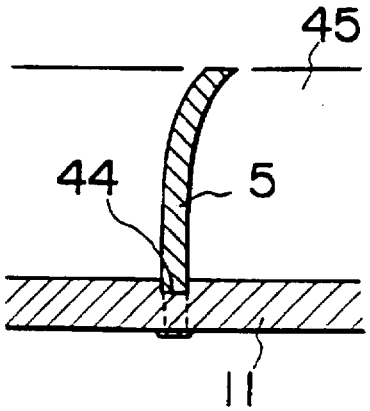

FIGS. 58 and 59 illustrate the cross sectional shape of the impeller which has been cut in the circumferential direction relative to the rotational center. As shown in FIG. 58, an insertion groove 44 having a width which is slightly narrower than the width of the blade 5 is formed in the annular groove 45 formed in the shroud 11. The blade 5 is press-fitted into the insertion groove 44. As a result, the airtightness between the blade 5 and the shroud 11 can be maintained. Further, as shown in FIG. 59, the fastening force can be further increased when the blade 5, having the caulking projections 41, is press-fitted and the caulking projections 41 are plastically worked.

Figure 60:
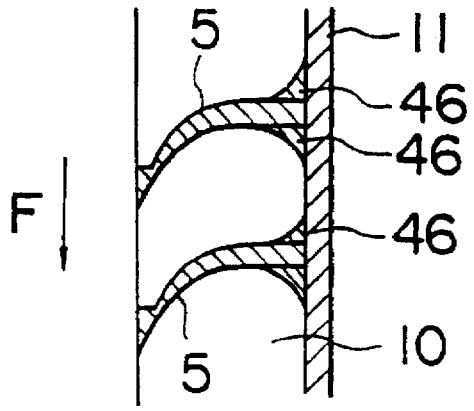

When the airtightness is desired to be improved, the corner portions between the blades 5 and the shroud 11 may be filled with a filler 46 as shown in FIG. 60. Since the filler 46 acts to permit air to smoothly flow in addition to improving the airtightness, it is preferable from a view point of improving the aerodynamic performance. As shown in FIG. 61, the filler 46 can be easily formed by brazing the blade 5, to which a skin material 47 of the low melting point has been brazed, in a furnace.

When the brazing shown in FIGS. 60 and 61 is performed, flux must be applied and then removed after it completed its roll. However, as shown in FIG. 62 when the impeller 1, in which the blade 5 has been secured to the shroud 11 by being press-fitted or by caulking its projections, is ultrasonic soldered in a jet type soldering tank 17 provided with a ultrasonic oscillator 16 while rotating the impeller 1, an oxide film formed on the surface to be soldered is broken by the supersonic erosion action, so that the application of the flux becomes unnecessary, thereby making it possible to efficiently manufacture the impeller 1 exhibiting excellent airtightness.

Another manufacturing method can be employed in which an adhesive is applied to the insertion groove 44 formed in the annular groove 45. As a result, the shape shown in FIG. 60 can be easily formed. That is, when the blade 5 is press-fitted into the insertion groove 44 formed in the shroud 11, a part of the adhesive overflows to the corner portion and solidifies, thereby causing an effect similar to that obtainable when the filler has been filled.

According to the above-described manufacturing methods, impellers of complicated shapes can be easily manufactured and thus obtained impellers can exhibit satisfactory airtightness.

In the embodiment of FIGS. 64–67, the blade 5 and the shroud 11 which have been independently manufactured are coupled to each other by using a screw.

Figure 64:
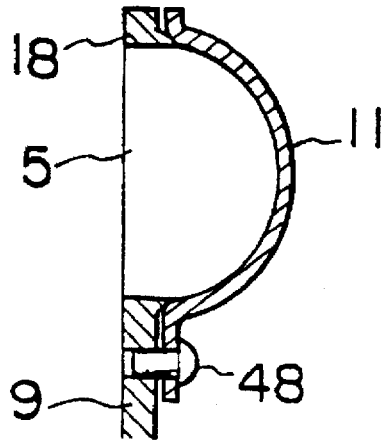
FIGS. 64 to 66 are perspective views each of which illustrates the shape of the blade.
Figure 65:
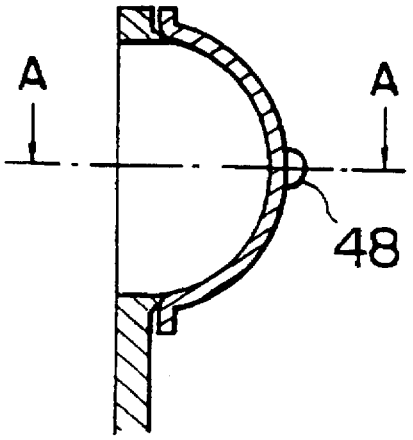
Figure 66:
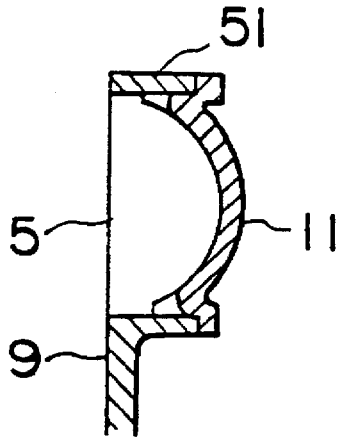
Figure 67:
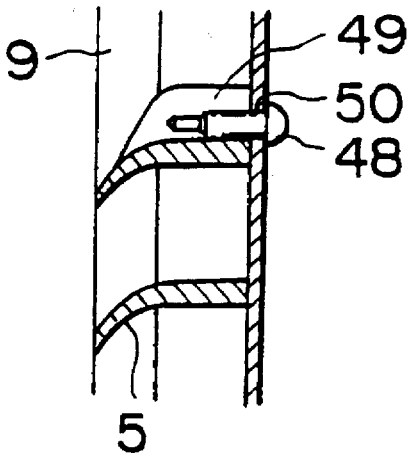
Figure 68A:
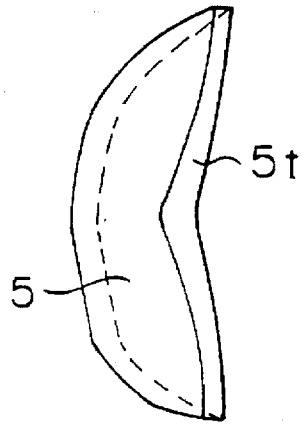
FIGS. 68(*a*), 68(*b*), and 68(*c*) are, respectively a front view, a plan view and a side view of the blade.
Figure 68B:
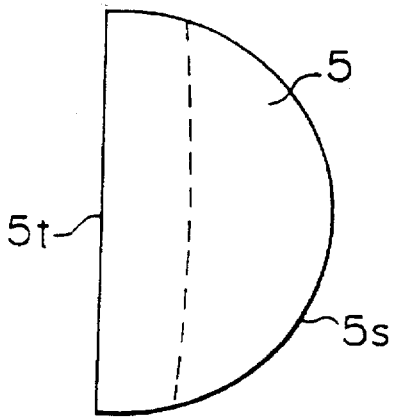
Figure 68C:
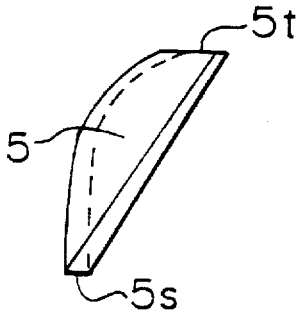
Figure 69:
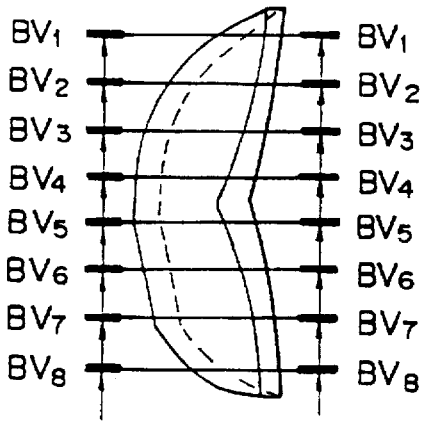
FIG. 69 is a view showing various positions at which the blade shown in FIG. 68 is sectioned.
Figure 70A:
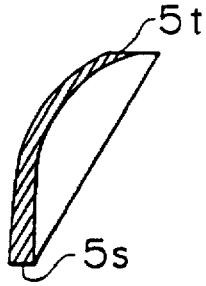
FIG. 70(*a*), 70(*b*), 70(*c*), 70(*d*), 70(*e*), 70(*f*), 70(*g*) and 70(*h*) are sectional view of the blade sectioned at the respective various positions shown in FIG. 69.
Figure 70B:
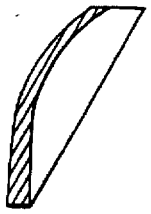
Figure 70C:
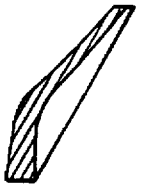
Figure 70D:
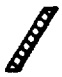
Figure 70E:
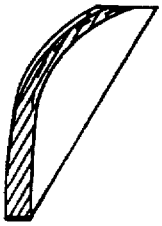
Figure 70F:
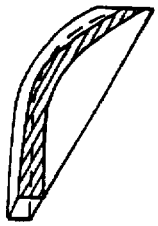
Figure 70G:
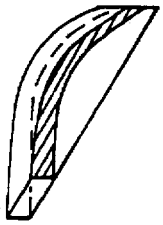
Figure 70H:
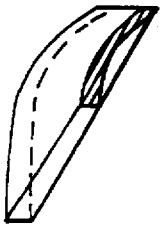
Figure 71A:
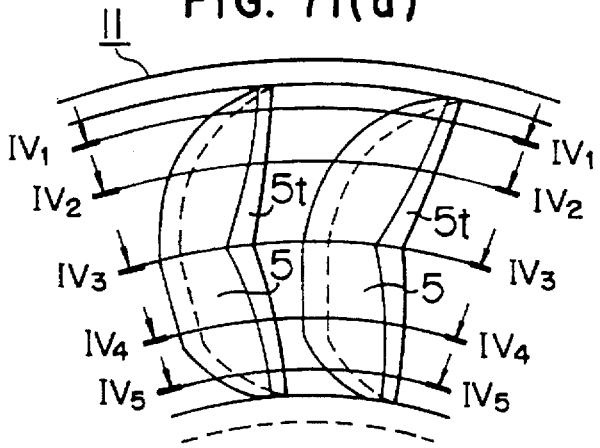
FIG. 71(*a*) is a drawing including a partial front view of an impeller provided with the blades shown in FIG. 68, FIG. 71(*b*) is a vertical sectional view and FIGS. 71(*c*), 71(*d*), 71(*e*), 71(*f*) and 71(*g*) are developed views of part of the impeller sectioned at the radially at the respective various positions shown in FIG. 71(*a*)
Figure 71B:
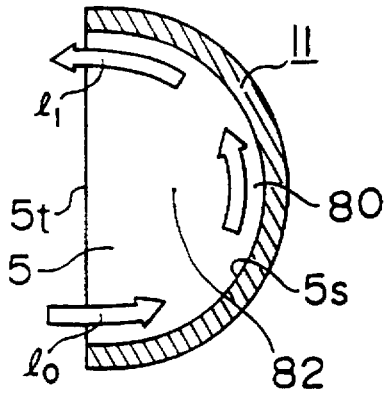
Figure 71C:
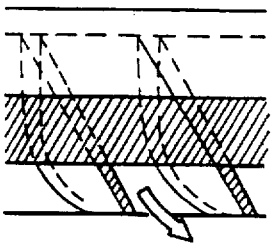
Figure 71D:
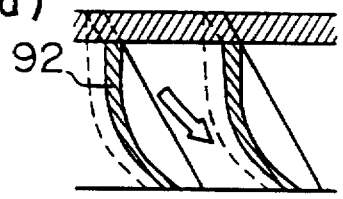
Figure 71E:
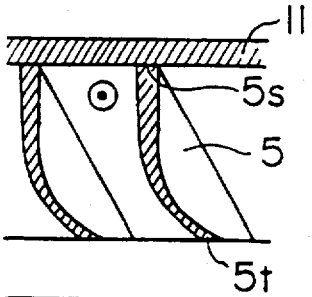
Figure 71F:
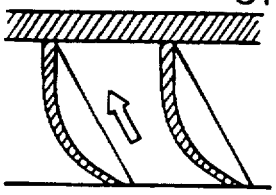
Figure 71G:
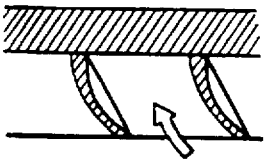

In an embodiment shown in FIG. 64, the shroud 11 may be secured to the wheel 9 by a screw 48 or it may be secured as shown in FIGS. 65 and 67 in such a manner that a part of the blade 5 is expanded so as to become an expansion portion 49 and a screw hole 50 is formed in the expansion portion 49 so as to be secured by the screw 48. It is preferable in terms of the performance that the expansion portion 49 be formed on the back side of the blade 5. Alternatively, a ring 51 connecting the outer front end of the blade 5 is manufactured integrally with the blade 5 and the wheel 9, and the shroud 11 is, as shown in FIG. 66, inserted between the ring 51 and the wheel 9 so as to be secured.

The wheel 9 may be integrally formed as a whole or only a part of the wheel 9 may be integrally formed with the blade 5.

In this way, since the blade and the shroud are independently manufactured and then they are coupled to each other, the mold can, of course, be manufactured easily and the mold can be readily removed after the casting has been completed. Therefore, impellers of a complicated shape can be readily manufactured.

Further, as described above, it is possible to form the annular groove 45 in such a manner that its width becomes less than that of the blade 5 and to provide the blade 5 in the groove 45 by inserting it while being elastically deformed, by using the adhesive or by using the filler.

A further embodiment of the present invention is shown in FIGS. 68–73. This embodiment differs from the above-mentioned embodiment in a point that a blade thickness is changed. That is, as mentioned previously, at the fluid inflow portion the blade is formed in such a shape that it is inclined with respect to both the rotational direction of the impeller 1 and a direction perpendicular to the wall surface of the shroud 11. And, the center portion 82 of the blade 5, which is situated above the portion 80 adjacent the shroud bottom wall, is formed substantially perpendicular to the bottom wall of the shroud 11.

In consequence, the flow flowing through the impeller is largely curved while passing from the inflow portion to the center portion, thereby forming a large turbulence at a backface side of the blade 5, and this becomes one of the causes of a pressure loss. This embodiment can suppress this turbulence formed at the backface 92 side of the blade and, as shown in FIGS. 68–71, a thickness of the blade at a side adjacent the shroud is increased in its backface side, thereby reducing a curve of the passage. FIG. 71 shows sections corresponding to FIGS. 4–6 in the first embodiment, and the blade thickness $T_2$ is changed in the backface side at every section.

Figure 72:
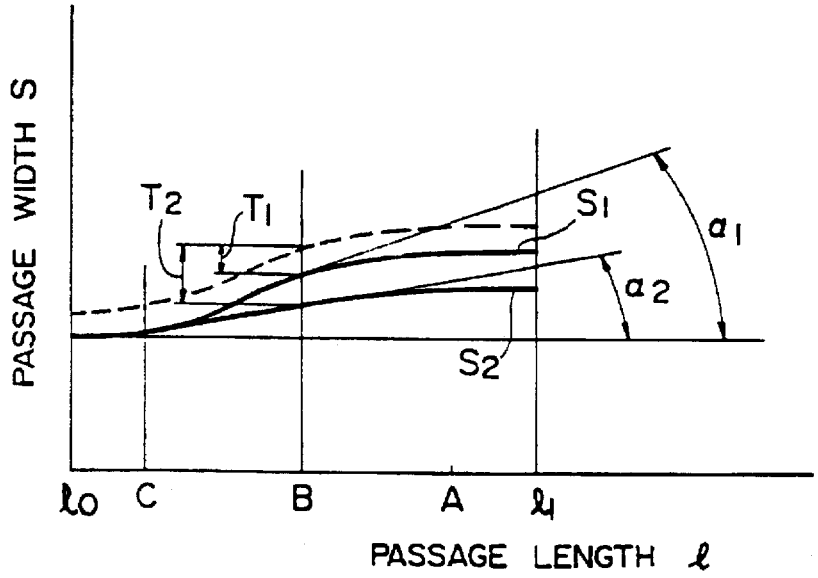
FIG. 72 is a graph showing a relationship between a length of a passage in the impeller shown in FIG. 71 and a width of the interblade passage.

Next, a relationship between a length l of the thus formed passage in the impeller and a width S of the interblade passage is shown in FIG. 72. In terms of a inclination $\alpha$ of the passage width to the passage length, which represents a degree of spread of the flow, in a conventional example there is a steeply spreading passage portion whose maximum value $\alpha_1$ is greater than 10°, whereas in this embodiment the maximum value $\alpha_2$ is smaller than $\alpha_1$ and so the spread of passage is gentle. Incidentally in FIG. 72 the marks $T_1$ and $S_1$ represent a blade thickness and an interblade passage width, respectively, in a case wherein the blade thickness is not changed in the above-mentioned embodiment.

Figure 73:
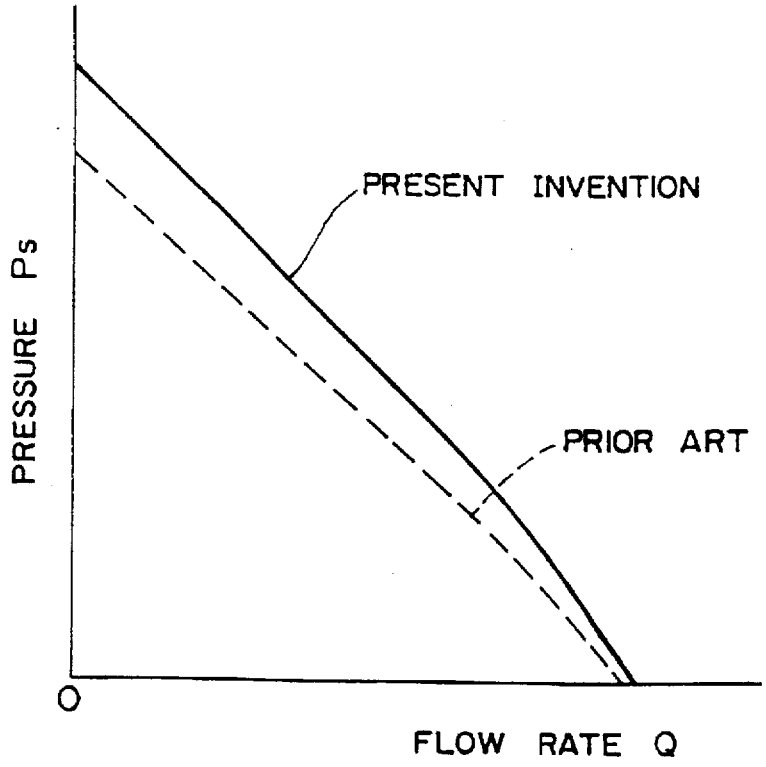
FIG. 73 is a graph for comparing a performance of the impeller shown in FIG. 71 with that of a conventional impeller.

Further, FIG. 73 shows a flow rate-pressure characteristic of a vortex flow blower wherein an impeller of this embodiment is used. In FIG. 73 the characteristic of a conventional vortex flow blower is shown by a broken line. Owing to the fact that the flow in the backface side of the blade becomes smooth, a pressure loss is reduced, a pressure characteristic is also improved and a maximum capacity is increased as well.

The first advantage according to the present invention can be obtained from the blade formed in such a manner that at least its inner portion is three dimensionally formed, thereby causing air to be smoothly introduced so as to be adapted to the speed vector of the swirling air flow. As a result, the discharge pressure can be significantly raised.

The second advantage can be obtained from the blade formed in such a manner that its shape is three dimensionally formed so as to be adapted to the speed vector of the swirling flow. Therefore, swirls and stagnation can be significantly prevented. As a result, a low noise vortex flow blower can be obtained.

The third advantage can be obtained from the partition wall formed in such a manner that its front end adjacent to the inlet port of the vortex flow blower is cut by the blade from the outside while the front end of the same adjacent to the outlet port is cut by the blade from the inside. Therefore, the air flow from the inlet port to the circular arc passage and the air flow discharged from the circular arc passage through the outlet port can be made smooth. As a result, noise can be extremely reduced.

The fourth advantage can be obtained from the blade formed in such a manner that the shape of the blade in the impeller is three dimensionally formed as mentioned before and $R_1/R_2$ can thereby be set to 0.75 or less and 0.3 or more. As a result, the size of the vortex flow blower can be reduced.

The fifth advantage can be obtained from the blade formed in such a manner that the shape of the blade at the outer portion of the impeller is retracted and the axial outlet angle is arranged to be 90° or more. Therefore, work imparted by the blade to air can be restricted. As a result, the discharge pressure and the required operating power can be controlled to a low level.

The sixth advantage can be obtained from the blade formed in such a manner that a middle portion in the front edge of the blade is retracted, a point at which the blade is connected to the shroud bottom wall surface is more retracted than the middle portion in the front edge and a center portion of the blade is provided in a direction substantially right above the shroud bottom wall surface. As a result, the flow flowing into the interblade passage can be efficiently swirled, thereby making it possible to increase a discharge pressure.

The seventh advantage can be obtained from the blade formed in such a manner that a thickness of the blade in its backface side is made larger only at a side adjacent the shroud wall surface than at other portions. As a result, an exfoliation and turbulence of the flow, which occur in the backface side of the blade, can be suppressed, thereby making it possible to generate a smooth flow as well as to achieve a high discharge pressure and high discharge capacity.

The eighth advantage can be obtained from the method of manufacturing an impeller, which is constituted in such a manner that the blade and the shroud are independently manufactured and then they are coupled to each other. Therefore, impeller of a complicated shape can be readily manufactured.

Further, as occasion demands, the airtightness can be improved and the flow can be made smooth by using a filler or an adhesive.

The ninth advantage lies in that the secondary moment of inertia of the impeller can be reduced and the starting torque required for the motor can be reduced since the blade can be independently manufactured and made of a thin and light material.

The tenth advantage lies in that impellers of different shapes can be readily manufactured since only the blade can be independently manufactured and, as a result, impellers of different aerodynamic performance can be readily manufactured.

We claim:

1. A method of manufacturing an impeller for a vortex flow blower wherein the impeller is mounted on a rotational shaft of the blower for rotation about an axis of said shaft, said impeller having a shroud with an annular shroud wall surface of semicircular cross-section defining an annular passage and a plurality of blades provided in said annular passage of said shroud to partition said annular passage at predetermined intervals, comprising the steps of independently manufacturing said shroud and said blades, including forming insertion holes in said shroud, and forming a plurality of caulking projections on each of said blades, and fitting said caulking projections into said insertion holes and directly mechanically coupling said blades to said shroud in a direction parallel to said axis of said shaft by plastically working the caulking projections with heat generated by an electric current applied thereto so as to compose said impeller with said blades exhibiting a curved surface in a radial section from a bottom center of said annular shroud wall surface and transversing the annular passage in a location corresponding to the both side surfaces of the annular passage and a location corresponding the bottom surface of the annular passage.

2. A method of manufacturing an impeller according to claim 1, wherein a filler or an adhesive is filled in corner portions between said shroud and said blades.

* * * * *